US006808853B2

(12) United States Patent
Kitani et al.

(10) Patent No.: US 6,808,853 B2
(45) Date of Patent: Oct. 26, 2004

(54) ELECTROSTATIC IMAGE DEVELOPING TONER AND PREPARATION METHOD THEREOF

(75) Inventors: Tomoe Kitani, Hachioji (JP); Takao Yamanouchi, Hachioji (JP); Naohiro Hirose, Hachioji (JP); Ken Ohmura, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/308,375

(22) Filed: Dec. 2, 2002

(65) Prior Publication Data

US 2003/0175610 A1 Sep. 18, 2003

(30) Foreign Application Priority Data

Dec. 5, 2001 (JP) ..... 2001-371190

(51) Int. Cl.[7] ..... G03G 9/087

(52) U.S. Cl. ..... 430/109.3; 430/111.4; 430/137.15

(58) Field of Search ..... 430/109.3, 111.4, 430/137.15

(56) References Cited

U.S. PATENT DOCUMENTS 5,447,813 A * 9/1995 Hagiwara et al. ..... 430/109.3
5,817,443 A * 10/1998 Matsushima et al. .... 430/109.3
6,475,688 B1 * 11/2002 Tamura et al. ..... 430/108.3
6,485,875 B1 * 11/2002 Karaki et al. ..... 430/108.23

* cited by examiner

*Primary Examiner*—John L Goodrow
(74) *Attorney, Agent, or Firm*—Squire Sanders & Dempsey

(57) ABSTRACT

An electrostatic image developing toner comprising a resin and a colorant is disclosed. The resin comprises a polymerization component of a polymerizable monomer having a polar group in an amount of 1.0 to 10.0 percent by weight, and a polymerization component of a polyfunctional polymerizable monomer in an amount of 0.1 to 10.0 percent by weight; ratio (A/B) is from 0.5 to 20.0 percent; and either a peak or a shoulder is positioned in the molecular weight region of 5,000 to 20,000, wherein A is an area of a chromatograph curve in the molecular weight region of 60,000 to 1,000,000, based on GCP measurement of a THF soluble component of toner and B is an entire area of the chromatograph curve.

11 Claims, 4 Drawing Sheets

TONER HAVING NO CORNERS

TONER HAVING CORNERS

TONER HAVING CORNERS

ELECTROSTATIC IMAGE DEVELOPING TONER AND PREPARATION METHOD THEREOF

FIELD OF THE INVENTION

The present invention relates to an electrostatic image developing toner and a production method of the same.

BACKGROUND OF THE INVENTION

In order to achieve high quality images similar to conventional photographic images when employing digital copiers and laser printers, preferred are images with high glossiness, which are prepared by employing smaller diameter toner particles. In order to decrease the toner particle diameter, toner particle preparation, employing a polymerization method, has received attention.

As described in Japanese Patent Publication Open to Public Inspection No. 2001-201887, known a pulverization type toner comprises at least a binding resin, a colorant and wax. Said patent publication discloses an electrostatic image developing toner in which, in regard to the GCP determined molecular weight of toner components which are soluble THF, the ratio of the molecular weight of at least $5\times10^5$ in an integral molecular weight distribution is at most 1 percent by weight; the ratio of the molecular weight of at most $3\times10^3$ in the integral molecular weight distribution is at most 30 percent by weight; and the ratio $\{W(5\times10^3)/W(1\times10^5)\}$, of the ratio $\{W(1\times10^3)\}$ of at most $1\times10^5$ in the molecular weight distribution to the ratio $\{W(1\times10^5)\}$ of at least $10^5$ in the integral molecular weight distribution, is from 15 to 50. Further, said patent publication discloses that by employing said toner, exhibited are effects such as improvements of fixability at lower temperatures as well as offsetting resistance, and formation of images with higher glossiness.

However, when the aforesaid techniques are applied to toner prepared by a polymerization method, the resultant image glossiness, fixability at lower temperatures, and fixing ratio do not meet market demands.

In the case of toner particles prepared by the known polymerization method and especially in the case of colored toner particles, resins, which have a lower molecular weight and a narrower molecular weight distribution, are suitable. On the other hand, when taking into account the aspect of image durability, resins comprised of higher molecular weight components are preferred. As a result, problems have occurred with compatibility between glossiness and image durability.

For example, in Japanese Patent Publication Open to Public Inspection No. 9-190012, the insoluble amount of crosslinked polymerization toner is specified, while in Japanese Patent Publication Open to Public Inspection No. 10-133419, mechanical strength is enhanced by specifying the kind of crosslinking agents. By so doing, enhancement in image durability is achieved, while characteristics of the resultant glossiness do not reach a satisfactory level. As a result, said compatibility between image durability and glossiness characteristics is not sufficiently achieved.

Further, Japanese Patent Publication Open to Public Inspection No. 2001-083730 discloses a method in which dispersion of aggregated particles comprised of fine resinous particles, as well as colorant particles, is prepared by mixing a dispersion in which fine resinous particles, having a diameter of at most 1 $\mu$m, and colorant particle dispersion, and subsequently, an electrostatic image developing toner is prepared via a process which fuses and coalesces said aggregated particles. Said patent publication also describes that by adjusting a crosslinked molecular weight, Mc, to the range of $3.5\times10^6$ to $7.5\times10^8$ and by holding the relationship of $14.0 \leqq \mathrm{Log10}(Mc/Me) \leqq 16.5$ between crosslinked molecular weight, Mc, and crosslinking density, Me, it becomes possible to simultaneously improve fixing characteristics such as adhesion properties of fixed images onto a fixing sheet, peeling properties of fixed sheets, hot offsetting resistance, surface glossiness of fixed images, and transparency of OHP, and further to enhance charging uniformity and satiability, while decreasing background staining as well as toner scattering.

However, even though this technique is employed, folding resistance of fixed images does not fully meet market needs, and further improvement has been demanded.

SUMMARY OF THE INVENTION

An object of the present invention is to provide an electrostatic image developing toner which results in excellent image glossiness, low temperature fixability, and fixing ratio, as well as exhibiting excellent folding resistance, and a production method of the same.

1. An electrostatic image developing toner comprising a resin and a colorant, wherein said resin comprises a polymerization component of a polymerizable monomer having a polar group in an amount of 1.0 to 10.0 percent by weight, as well as a polymerization component of a polyfunctional polymerizable monomer in an amount of 0.1 to 10.0 percent by weight; ratio (A/B), wherein A is the area of a chromatograph curve in the molecular weight region of 60,000 to 1,000,000, based on GCP measurement of a THF soluble component of toner and B is the entire area of said chromatograph curve, is from 0.5 to 20.0 percent; and either a peak or a shoulder is positioned in the molecular weight region of 5,000 to 20,000.
2. An electrostatic image developing toner wherein the polyfunctional polymerizable monomers are the compounds represented by Formulas (1) through (4).

Formula (1)

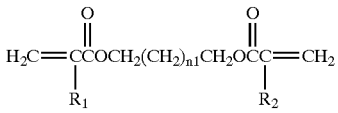

In the formula each of $R_1$ and $R_2$ is a hydrogen atom, an alkyl group having 1 to 6 carbon atoms or a cycloalkyl group, $n_1$ is an integer of 1 to 32.

Formula (2)

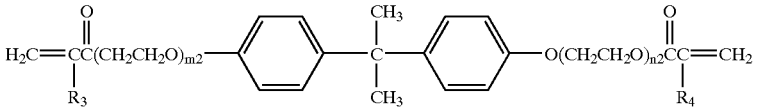

In the formula each of $R_3$ and $R_4$ is a hydrogen atom, an alkyl group having 1 to 6 carbon atoms or a cycloalkyl group, each of $m_1$ and $m_2$ is an integer, the sum of $m_1$ and $n_2$ being 1 to 32.

Formula (3)

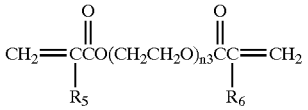

In the formula each of $R_5$ and R6 is a hydrogen atom, an alkyl group having 1 to 6 carbon atoms or a cycloalkyl group, $n_3$ is an integer of 1 to 32.

Formula (4)

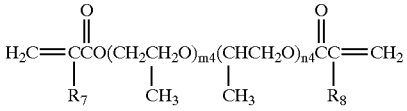

In the formula each of $R_7$ and $R_8$ is a hydrogen atom, an alkyl group having 1 to 6 carbon atoms or a cycloalkyl group, each of $m_4$ and $n_4$ is an integer, the sum of $m_4$ and $n_4$ being 1 to 32.

3. An electrostatic image developing toner wherein the toner is prepared via a process in which resins are prepared by polymerizing polymerizable monomers in a water based medium.
4. An electrostatic image developing toner wherein toner is comprised of toner which is prepared via a process in which resinous particles are aggregate-fused in a water based
5. A production method of an electrostatic image developing toner described in any one of 1. through 4. above, comprising a process in which a binding resin is prepared via a process of polymerizing a polymerizable monomer in a water based medium.
6. A production method of an electrostatic image developing toner described in any one of 1. through 4. above, comprising a process in which the toner particles are prepared via a process of coagulating and fusing binder resin particles in a water based medium.
7. A production method of an electrostatic image developing toner described in any one of 1. through 4. above, comprising a process in which the toner particles are prepared via a process of salting-out, coagulating and fusing binder resin particles prepared by polymerizing a polymerizable monomer and colorant particles in a water based medium.
8. A production method of an electrostatic image developing toner described in any one of 1. through 4. above, comprising a process in which the toner particles are prepared via a process of salting-out, coagulating and fusing binder resin particles prepared by multi-step polymerizing a polymerizable monomer and colorant particles in a water based medium.
9. A production method of an electrostatic image developing toner described in any one of 1. through 4. above, comprising a process in which the toner particles are prepared by forming a binder resin layer by salting-out, coagulating and fusing binder resin particles on a colored particles comprising resin particles and colorant particles.
10. An electrostatic image developing toner prepared by one of production methods described in any one of 5. through 9. above.
11. An image forming method comprising visualizing electrostatic latent image formed on a photoreceptor, and transferring and thermally fixing the visualized image to a recording media, wherein the electrostatic latent image formation is conducted by digital exposure on the photoreceptor, the thermally fixing is conducted by a fixing unit comprising endless belt shaped film, and the visualizing is conducted by a toner described in any one of 1. through 4. and 10. above.

BRIEF DESCRIPTION OF THE DRAWING

FIGS. 1(*b*) and 1(*c*): A Schematic view of toner having corner

DETAILED DESCRIPTION OF THE INVENTION

Figure 1:
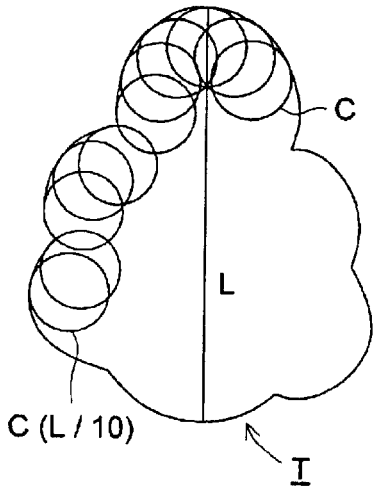
FIG. 1(*a*): A Schematic view of toner having no corner
Figure 1:
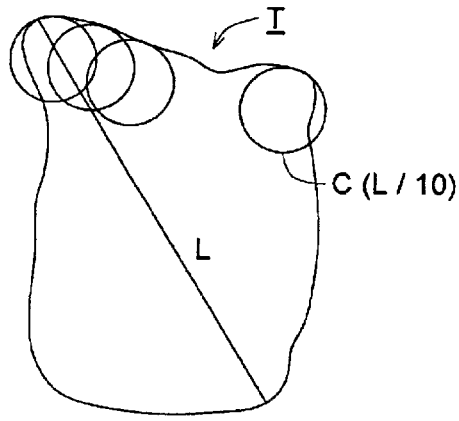
Figure 1:
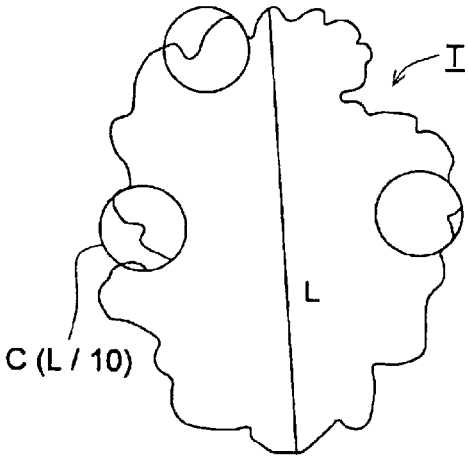

The toner of the present invention comprises a resin having a polar group and colorants, and the resin comprises a polymerization component of the polymerizable monomer having a polar group in an amount of 1.0 to 10.0 percent by weight, as well as a polyfunctional polymerizable monomer in an amount of 1 to 10 percent by weight. Further, ratio (A/B), wherein A is the area of a chromatograph curve in the molecular weight region of 60,000 to 1,000,000, based on GPC measurement of a THF soluble component of said toner and B is the entire area of said chromatograph curve, is from 0.5 to 20.0 percent, and either a peak or a shoulder is located in the molecular weight region of 5,000 to 20,000.

Polymerizable monomers, having a polar group according to the present invention, will now be described.

The resin comprises, as a resin constituting component, the polymerization component of a polymerizable monomer, having a polar group, typically in an amount of 1.0 to 10.0 percent by weight, and preferably from 1 to 7 percent by weight.

The polymerization component(s) of the monomer having a polar group, which forms a resin, may be comprised of either one type of polymerization component or a plurality of polymerization components.

The polymerizable monomers, having a polar group, will now be described.

The polymerizable monomers, having a polar group, include a monomer having an acidic polar group as well as a monomer having a basic polar group. These are detailed below.

(I) Monomers Having an Acidic Polar Group

Listed as monomers having an acidic group may be (a) α,β-ethylenic unsaturated compounds having a carboxylic group (—COOH), and (b) α,β-ethylenic unsaturated compounds having a sulfo group (—$SO_3H$).

Listed as examples of α,β-ethylenic unsaturated compounds having a carboxylic group, included in (a) above, may be acrylic acid, methacrylic acid, fumaric acid, maleic acid, itaconic acid, cinnamic acid, monobutyl maleate, and monooctyl maleate and metal salts thereof, such as Na salts and Zn salts.

Of these, acrylic acid and methacrylic acid are preferably employed. Listed as examples of α,β-ethylenic unsaturated compounds having a sulfo group, included in (b) above, may be sulfonated styrene and Na slats thereof, and allylsulfosuccinic acid and octyl allylsulfosuccinate and Na salts thereof.

(II) Monomers Having a Basic Polar Group

Exemplified as monomers having a basic polar group may be (a) (meth)acrylic acid esters of aliphatic alcohols having an amine group or a quaternary ammonium group, as well as having from 1 to 12 carbon atoms, preferably from 2 to 8 carbon atoms, and most preferably 2 carbon atoms, (b) (meth)acrylic acid amides or (meth)acrylic acid amides which are subjected to mono- or di-substitution on an optional N employing an alkyl group having from 1 to 18 carbon atoms, (c) vinyl compounds substituted with a heterocyclic group having N as a ring member, and (d) N,N-diallyl-alkylamines or ammonium salts thereof. Of these, preferred as monomers having a basic polar group are (meth)acrylic acid esters of aliphatic alcohols having an amine group or a quaternary ammonium salt, included in (a) above.

Listed as examples of (meth)acrylic acid esters of aliphatic alcohols, having an amine group or a quaternary ammonium group, included in (a) above, may be dimethyl aminoethyl acrylate, dimethyl aminoethyl methacrylate, diethyl aminoethyl acrylate, diethyl aminoethyl methacrylate, quaternary ammonium salts of said four compounds, 3-dimethylaminophenyl acrylate, and 2-hydroxy-3-methacyloxypropyltrimethyl ammonium salt.

Listed as (meth)acrylic acid amides or (meth)acrylic acid amides which are subjected to mono- or di-substitution on an optional N, included in (b) above, may be acrylamide, N-butylacrylamide, N,N-dibutylacrylamide, piperidylacrylamide, methacrylamide, N-butylmethacrylamide, N,N-dimethylacrylamide, and N-octadecylacrylamide.

Listed as vinyl compounds substituted with a heterocyclic group having N as a ring member, included in (c) above, may be vinylpyridine, vinylpyrrolidone, vinyl-N-methylpyridinium chloride, and vinyl-N-ethylpyridinium chloride.

Listed as examples of N,N-diallyl-alkylamines, included in (d) above, may be N,N-diallylmethylammonium chloride and N,N-diallylethylammonium chloride.

Polyfunctional polymerizable monomers will now be described.

Listed as polyfunctional polymerizable monomers are molecules in which the length of the molecular axis ranges from a short chain type to a long chain type, and the long chain type is preferably employed. The molecular axis, as described in the present invention, refers to the molecular axis which is comprised of atoms constituting the chain from one polymerizable functional group to the other polymerizable functional group. Incidentally, hydrogen atoms are not considered as an atom constituting the molecular axis.

The short chain type, as described herein, refers to the type in which the number of atoms which constitute the chain from one polymerizable functional group to the other polymerizable functional group is less than or equal to 11.

Preferred as polyfunctional polymerizable monomers according to the present invention are those represented by aforesaid General Formulas (1), (2), (3), and (4).

In each of General Formulas (1), (2), (3), and (4), the alkyl group having from 1 to 6 carbon atoms, represented by $R_1$ through $R_8$ may be in the form of either a branched chain or a straight chain, and include, for example, a methyl group, an ethyl group, a propyl group, a butyl group, a pentyl group, an iso-pentyl group, and a hexyl group.

In each of General Formulas (1) through (4), listed as cycloalkyl groups represented by $R_1$ through $R_8$ are, for example, a cyclopentyl group and a cyclohexyl group.

Each of groups represented by $R_1$ through $R_8$ may further have a substituent.

Further, in the polyfunctional polymerizable monomers, preferably employed are those having from 9 to 40 carbon atoms in the main chain.

The main chain of polyfunctional polymerizable monomers, as described herein, refers to a chain from one terminal polymerizable functional group, specifically represented by unsaturated polymerizable groups such as an acryloyl group as well as a methacryloyl group, to the other terminal polymerizable functional group. When the main chain includes a ring structure, the number of carbons is counted by selecting a path which includes the minimal number of carbon atoms.

The resins according to the present invention comprise polyfunctional polymerizable monomers commonly in an amount of 0.1 to 10.0 percent by weight. Said content ratio is preferably from 0.5 to 7.0 percent by weight, and is more preferably from 1 to 5 percent by weight.

Polyfunctional polymerizable monomers in the resin may be comprised of either one type of a polymerization component or a plurality of types.

Specific examples of polyfunctional polymerizable monomers, represented by each of General Formulas (1) through (4) will now be illustrated.

General Formula (1)

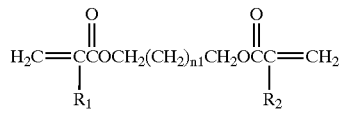

| | $R_1$ | $R_2$ | n1 |
|---|---|---|---|
| 1-1 | $CH_3$ | $CH_3$ | 4 |
| 1-2 | $CH_3$ | $CH_3$ | 7 |
| 1-3 | $CH_3$ | $CH_3$ | 8 |
| 1-4 | H | H | 4 |
| 1-5 | H | H | 7 |
| 1-6 | H | H | 8 |

General Formula (2)

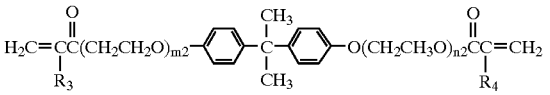

| | $R_3$ | $R_4$ | (m2 + n2)* |
|---|---|---|---|
| 2-1 | $CH_3$ | $CH_3$ | Ca.2.3 |
| 2-2 | $CH_3$ | $CH_3$ | Ca.2.6 |
| 2-3 | $CH_3$ | $CH_3$ | Ca.4 |
| 2-4 | $CH_3$ | $CH_3$ | Ca.10 |
| 2-5 | H | H | Ca.4 |

*(m2 + n2) is the analytical value of each compound.
Ca. means circa.

General Formula (3)

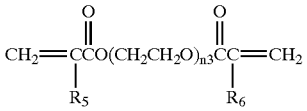

| | $R_5$ | $R_6$ | n3* |
|---|---|---|---|
| 3-1 | $CH_3$ | $CH_3$ | 2 |
| 3-2 | $CH_3$ | $CH_3$ | 3 |
| 3-3 | $CH_3$ | $CH_3$ | Ca.1 |
| 3-4 | $CH_3$ | $CH_3$ | Ca.9 |
| 3-5 | $CH_3$ | $CH_3$ | Ca.14 |
| 3-6 | $CH_3$ | $CH_3$ | Ca.23 |
| 3-7 | H | H | Ca.4 |
| 3-8 | H | H | Ca.9 |
| 3-9 | H | H | Ca.14 |
| 3-10 | $CH_3$ | $CH_3$ | 1 |

*n3 is the analytical value of each compound.
Ca. means circa.

General Formula (4)

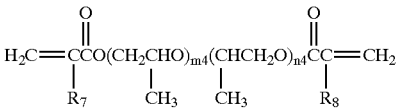

| | $R_7$ | $R_8$ | (m4 + n4)* |
|---|---|---|---|
| 4-1 | $CH_3$ | $CH_3$ | Ca.7 |
| 4-2 | H | H | Ca.3 |
| 4-3 | H | H | Ca.7 |
| 4-4 | H | H | Ca.12 |

*(m4 + n4) is the analytical value of each compound.
Ca. means circa.

These compounds are commercially available, for example, as products of Shin-Nakamura Kagaku Kogyo Co., Ltd.

In order to prepare polymerization components which are constitution components of the resins according to the present invention, it is possible to employ monomers other than the aforesaid polymerizable monomers, having a polar group, and further they may be employed individually or in combination of at least two types so as to achieve desired characteristics.

Specifically employed may be monovinyl aromatic monomers, (meth)acrylic acid ester based monomers, vinyl ester based monomers, vinyl ether based monomers, monoolefin based monomers, diolefin based monomers, and halogenated olefin based monomers.

Listed as vinyl aromatic based monomers are, for example, styrene based monomers, and derivatives thereof, such as styrene, o-methylstyrene, m-methylstyrene, p-methylstyrene, p-methoxystyrene, p-phenylstyrene, p-chlorostyrene, p-ethyl-styrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene.

Listed as (meth)acrylic acid ester based monomers are acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, and diethyl aminoethyl methacrylate.

Listed as vinyl ester based monomers are vinyl acetate, vinyl propionate, and vinyl benzoate. On the other hand, listed as vinyl ether based monomers are vinyl methyl ether, vinyl ethyl ether, vinyl isobutyl ether, and vinyl phenyl ether.

Further, listed as monoolefin based monomers are ethylene, propylene, isobutylene, 1-butene, 1-pentene, and 4-methyl-1-pentene. Listed as diolefin based monomers are butadiene, isoprene, and chloroprene.

<<Molecular Weight Characteristics of THF-Soluble Components of Toner>>

The electrostatic image developing toner of the present invention has a ratio (A/B) of 0.5 to 20.0 percent wherein A is the area of the chromatograph curve in the molecular weight range of 60,000 to 1,000,000 based on the GPC measurement of THF-soluble components, and B is the entire area of said chromatograph curve, and has either a peak or shoulder in the molecular weight region of 5,000 to 20,000.

Entire area B of the chromatograph curve, as described herein, represents the entire chromatograph curve from the time when a detector detects components other than solvents to the time when lower molecular weight components flow out from the column. An area occupied by said chromatograph curve in the specified molecular weight range is expressed as a percentage, while the total area is to be 100 percent.

The shoulder refers to the inflection of the aforesaid chromatograph curve.

Ratio (A/B) is preferably from 1 to 12 percent, wherein A is the area of the chromatograph curve in the molecular weight range of 60,000 to 1,000,000, and B is the entire area of said chromatograph curve, and is more preferably from 5 to 10 percent.

Further, the toner of the present invention has either a peak or a shoulder in the molecular weight range of 5,000 to 20,000, corresponding to the lower molecular weight range. Said toner has either a peak or shoulder preferably in the molecular weight range of 6,000 to 15,000 and more preferably in the molecular weight range of 8,000 to 10,000.

<<GPC Measurement Conditions of THF-Soluble Components of Toner>>

The molecular weight of the THF-soluble components of toner is measured employing GPC (gel permeation chromatography) while using THF (tetrahydrofuran) as a solvent.

In order to prepare a sample solution, 0.5 to 5.0 mg of the sample is measured out. THF is added to the measured sample in an amount of 1 ml per 1 mg of the sample, and the resulting mixture is stirred at room temperature employing a stirrer, such as a magnetic stirrer, so that the sample is completely dissolved.

Subsequently, the resultant solution is filtered using a membrane filter with a pore size of 0.45 to 0.50 $\mu$m, and the resulting filtrate is injected into GPC. GPC measurement is carried out as follows. The column is stabilized at 40° C., THF is allowed to flow at a rate of 1 ml per minute, and the approximately 100 $\mu$l sample at a concentration of 1 mg/ml is injected.

It is preferable that employed as columns to use for measurements are combinations of commercially available gel columns. For example, it is possible to list combinations of Shodex GPC KF-801, 802, 803, 804, 805, 806, and 807, manufactured by Showa Denko Co., Ltd. and combinations of TSKgel G1000H, G2000H, G3000H, G4000H, G5000H, and G6000H, and G7000H, and a TSK guard column, manufactured by Tosoh Co., Ltd.

Preferably employed as detectors are refractive index detectors (RI detector) or ultraviolet (UV) detectors. The molecular weight of samples is calculated employing a calibration curve in which the molecular weight distribution of the sample is prepared employing standard monodispersed polyethylene particles. Approximately 10 standard polyethylene samples are preferably employed to determine said calibration curve.

<<Softening Point of Toner>>

The softening point of the electrostatic image developing toner of the present invention is preferably from 95 to 110° C., and is more preferably from 100 to 105° C.

The measurement of the softening point will now be detailed.

A flow tester CFT500 type (manufactured by Shimadzu Corporation) is used. A sample in a weight of approximately 1.0 g is measured out and charged into said flow tester. After removing air from the charged sample, measurements are carried out employing said flow tester under the conditions described below. The plunger position at 180° C. is read from the obtained temperature-plunger position curve, and the flow amount is obtained based on the difference from the initial plunger position.

| Settings | |
|---|---|
| Rate of temperature increase | 6.0 (in ° C./minute) |
| Initial temperature | 70.0 (in ° C.) |
| Intended temperature | 180 (in ° C.) or higher |
| Measurement interval | 3.0 (in ° C.) |
| Preheating period | 300 (in second) |
| Measurement load | 196.13 (in N) |
| Die hole diameter | 1.0 (in mm) |
| Die length | 1.0 (in mm) |
| Piston area | 1.0 (in $cm^2$) |

Physical parameters of the shape of toner particles according to the present invention will now be described.

<<Shape Factor of Toner>>

In the toner of the present invention, it is preferable that the ratio of toner particles, having a shape factor in the range of 1.01 to 1.60, is at least 65 percent by number with respect to the number of all toner particles, and the variation coefficient of the shape factor, described below, is at most 16 percent.

The shape factor of the toner of the present invention is represented by the formula described below and shows the degree of circularity of a toner particle.

$$\text{Shape factor} = \{(\text{maximum diameter}/2)^2 \times \pi\}/\text{projected area}$$

The maximum diameter, as described herein, refers to the width of a particle so that when the projected image of a toner particle onto a plane is interposed by two parallel lines, the distance between said two parallel lines is maximal. Further, the projected area, as described herein, refers to the area of the image of a toner particle projected onto a plane. In the present invention, said shape factor was determined as follows. Toner particles were enlarged by a factor of 2,000, employing a scanning type electron microscope and then photographed. Subsequently, the resulting photograph was subjected to photographic image analysis, employing a "Scanning Image Analyzer" (manufactured by JEOL Ltd.), so as to determine the shape factor. In such a case, 1,000 toner particles were employed and the shape factor of the present invention was determined employing the aforesaid calculation formula.

Variation Coefficient the Shape Coefficient

The variation coefficient the shape coefficient of the polymerized toner is calculated using the formula described below:

$$\text{Variation coefficient}=(S1/K)\times 100 \text{ (in percent)}$$

wherein S1 represents the standard deviation of the shape coefficient of 100 toner particles and K represents the average of said shape coefficient.

The variation coefficient is preferably not more than 16%, and more preferably not more than 14% in the present invention. In order to control said shape coefficient of toner uniformly as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles (polymer particles).

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Methods for measuring said shape coefficient are not limited. For example, toner particles are enlarged by a factor of 500 employing an electron microscope and photographed. Subsequently, the circularity of at least 500 toner particles is determined, employing an image analysis apparatus. The arithmetic average is then obtained so that an average circularity can be calculated. Further, as a simple measurement method, it is possible to conduct measurement, employing FPIA-1000 (produced by Toa Medical Electronics Co., Ltd.).

Number Variation Coefficient in Number Particle Size Distribution

The number particle distribution as well as the number variation coefficient of the toner of the present invention is measured employing a Coulter Counter TA-11 or a Coulter Multisizer (both manufactured by Coulter Co.).

In the present invention, employed was the Coulter Multisizer which was connected to an interface which outputs the particle size distribution (manufactured by Nikkaki), as well as on a personal computer.

Employed as used in said Multisizer was one of a 100 $\mu$m aperture. The volume and the number of particles having a diameter of at least 2 $\mu$m were measured and the size distribution as well as the average particle diameter was calculated. The number particle distribution, as described herein, represents the relative frequency of toner particles with respect to the particle diameter, and the number average particle diameter as described herein expresses the diameter accumulated to 50%, that is, Dn 50, in the number particle size distribution.

The number variation coefficient in the number particle distribution of toner is calculated employing the formula described below:

$$\text{Number variation coefficient}=(S/D_n)\times 100 \text{ (in percent)}$$

wherein S represents the standard deviation in the number particle size distribution and $D_n$ represents the number average particle diameter (in $\mu$m).

The number variation coefficient of the toner of the present invention is not more than, preferably, 27 percent, and is more preferably not more than 25 percent. By adjusting the number variation coefficient to not more than 27 percent, voids of the transferred toner layer decrease to improve transfer efficiency at the second transfer to the image forming support and therefore good image transfer characteristics is obtained. Further, the width of the charge amount distribution is narrowed and image quality is enhanced due to an increase in transfer efficiency.

Methods to control the number variation coefficient of the present invention are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation. Toner particles having no corners The toner particles of the present invention, which substantially have no corners, as described herein, mean those having no projection to which charges are concentrated or which tend to be worn down by stress. Namely, as shown in FIG. 1(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference.

Further, "the main axis of a toner particle" as described herein means the maximum width of said toner particle when the projection image of said toner particle onto a flat plane is placed between two parallel lines. Incidentally, FIGS. 1(*b*) and 1(*c*) show the projection images of a toner particle having corners.

Toner having no corners was measured as follows. First, an image of a magnified toner particle was made employing a scanning type electron microscope. The resultant picture of the toner particle was further magnified to obtain a photographic image at a magnification factor of 15,000. Subsequently, employing the resultant photographic image, the presence and absence of said corners was determined. Said measurement was carried out for 100 toner particles.

In the toner of the present invention, the ratio of the number of toner particles having no corners is generally at least 50 percent, and is preferably at least 70 percent. By adjusting the ratio of the number of toner particles having no corners to at least 50 percent, the formation of fine toner particles and the like due to stress with a developer conveying member and the like tends not to occur. Thus it is possible to minimize the formation of a so-called toner which excessively adheres to the developer conveying member, and simultaneously minimizes staining onto said developer conveying member, as well as to narrow the charge amount distribution. Thus, since the charge amount distribution is narrowed, it is possible to stabilize chargeability, resulting in excellent image quality over an extended period of time.

The toner having no corners can be obtained by various methods. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

The polymerized toner, which is preferably employed in the present invention, is as follows. The diameter of toner particles is designated as D (in $\mu$m). In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class.

By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

In the present invention, the histogram, which shows said number based particle size distribution, is one in which natural logarithm lnD (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

(Measurement Conditions)

(1) Aperture: 100 μm (2) Method for preparing samples: an appropriate amount of a surface active agent (a neutral detergent) is added while stirring in 50 to 100 ml of an electrolyte, ISOTON R-11 (manufactured by Coulter Scientific Japan Co.) and 10 to 20 mg of a sample to be measured is added to the resultant mixture. Preparation is then carried out by dispersing the resultant mixture for one minute employing an ultrasonic homogenizer.

The diameter of the toner particles of the present invention is preferably from 3 and 9 μm, preferably from 4.5 to 8.5 μm, and more preferably from 5 to 8 μm in terms of the number average particle diameter.

When toner particles are formed employing a polymerization method, it is possible to control said particle diameter utilizing the concentration of coagulants, the added amount of organic solvents, the fusion time, or further the composition of the polymer itself.

By adjusting the number average particle diameter from 3 to 9 μm, it is possible to improve the transfer efficiency and the halftone image quality as well as general image quality of fine lines, dots, and the like.

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer.

The production method of the toner of the present invention will now be described. The resin particles of the toner are preferably produced by preparing resin particles by polymerization of polymeric monomer in an aqueous medium. The methods include a process preparing particles by a suspension polymerization method, or an emulsion polymerization method or a mini-emulsion polymerization method and then salting out/coagulating.

Suspension Polymerization

When the toner is produced by the suspension polymerization method, the production is performed by the following procedure. Various raw materials such as a colorant, a mold releasing agent according to necessity, a charge controlling agent and a polymerization initiator are added into a polymerizable monomer and dispersed or dissolved by a homogenizer, a sand mill, a sand grinder or a ultrasonic dispersing apparatus. The polymerizable monomer in which the raw materials are dissolved or dispersed is dispersed into a form of oil drops having a suitable size as toner particle by a homo-mixer or a homogenizer in an aqueous medium containing a dispersion stabilizing agent. Then the dispersion is moved into a reaction vessel having a stirring device with double stirring blades, and the polymerization reaction is progressed by heating. After finish of the reaction, the dispersion stabilizing agent is removed from the polymer particles and the polymer particles are filtered, washed and dried to prepare a toner. In the invention, the "aqueous medium" is a medium containing at least 50% by weight of water.

Emulsion Polymerization

The toner according to the invention can be also obtained by salting-off/fusing resin particles. For example, the methods described in JP O.P.I. Nos. 5-265252, 6-329947 and 9-15904 are applicable. The toner can be produced by a method by which dispersed particles of constituting material such as resin particles and colorant or fine particles constituted by resin and colorant are associated several by several. Such the method is realized particularly by the following procedure: the particles are dispersed in water and the particles are salted-out by addition of a coagulation agent in an amount of larger than the critical coagulation concentration. At the same time, the particles are gradually grown by melt-adhesion of the particles by heating at a temperature higher than the glass transition point of the produced polymer. The particle growing is stopped by addition of a large amount of water when the particle size is reached at the prescribed diameter. Then the surface of the particle is made smooth by heating and stirring to control the shape of the particles. The particles containing water in a fluid state are dried by heating. Thus the toner can be produced. In the foregoing method, an infinitely water-miscible solvent such as alcohol may be added together with the coagulation agent.

The toner particles are preferably prepared by a process in which a releasing agent (a crystalline material) is dissolved in polymerizable monomer, then fine composite particles obtained by polymerization and a colorant is subjected to salting/fusion. A crystalline material is incorporated in polymerizable monomer liquid in a melted or dissolved state during at least a part of the polymerization process.

The toner according to the invention is preferably obtained by salting-off/fusing fine composite resin particles prepared by the multi-step polymerization and colorant. The multi-step polymerization is detailed.

The preferable production process preferably comprises the following processes:

1. A multi-step polymerizing process
2. A salting-out/coagulation process to produce a toner particle by salting-out/coagulating the compound resin particles and colored particles
3. Filtering and washing processes to filter the toner particles from the toner particle dispersion and to remove a unnecessary substance such as the surfactant from the toner particles
4. A drying process to dry the washed toner particles
5. A process to add an exterior additive to the toner particles Each of the processes is described below.

(Multi-step Polymerization Process)

The multi-step polymerization process is a process for preparing the composite resin particle having broader molecular weight distribution. A plural of polymerization reaction is conducted in separate steps so that each particle has different layers having different molecular weight. The obtained particle has a gradient of molecular weight from the center to the surface of the particle. For example, a lower molecular weight surface layer is formed by adding a polymerizable monomer and a chain transfer agent after obtaining a higher molecular weight polymer particles. dispersion.

It is preferred from the viewpoint of the stability and the anti-crush strength of the obtained toner to apply the multi-step polymerization including three or more polymerization steps. The two- and tree-step polymerization methods, which are representative examples, are described below. It is preferable that the closer to the surface the molecular weight is lower in view of the anti-crush strength.

(Two-step Polymerization Method)

The two-step polymerization method is a method for producing the composite resin particle comprised of the central portion (core) containing the crystalline material comprising the high molecular weight resin and an outer layer (shell) comprising the low molecular weight resin.

In concrete, a monomer liquid is prepared by incorporating the crystalline material in a monomer, the monomer liquid is dispersed in an aqueous medium (an aqueous solution of a surfactant) in a form of oil drop, and the system is subjected to a polymerization treatment (the first polymerization step) to prepare a dispersion of a higher molecular weight resin particles each containing the crystalline material.

Next, a polymerization initiator and a monomer to form the lower molecular weight resin is added to the suspension of the resin articles, and the monomer L is subjected to a polymerization treatment (the second polymerization step) to form a covering layer composed of the lower molecular weight resin (a polymer of the monomer) onto the resin particle.

(Three-step Polymerization Method)

The three-step polymerization method is a method for producing the composite resin particle comprised of the central portion (core) comprising the high molecular weight resin, the inter layer containing the crystalline material and the outer layer (shell) comprising the low molecular weight resin.

In concrete, a suspension of the resin particles prepared by the polymerization treatment (the first polymerization step) according to a usual procedure is added to an aqueous medium (an aqueous solution of a surfactant) and a monomer liquid prepared by incorporating the crystalline material in a monomer is dispersed in the aqueous medium. The aqueous dispersion system is subjected to a polymerization treatment (the second polymerization step) to form a covering layer (inter layer) comprising a resin (a polymer of the monomer) containing the crystalline material onto the surface of the resin particle (core particle). Thus a suspension of combined resin (higher molecular weight resin-middle molecular weight resin) particles is prepared.

Next, a polymerization initiator and a monomer to form the lower molecular weight resin is added to the dispersion of the combined resin particles, and the monomer is subjected to a polymerization treatment (the third polymerization step) to form a covering layer composed of the low molecular weight resin (a polymer of the monomer) onto the composite resin particle.

In the three-step polymerization method, the crystalline material can be finely and uniformly dispersed by applying a procedure, at the time of forming the inter layer on the resin particle.

The polymer is preferably obtained by polymerization in the aqueous medium. The crystalline material is incorporated in a monomer, and the obtained monomer liquid is dispersed in the aqueous medium as oil drop at the time of forming resin particles (core) or covering layer thereon (inter layer) containing the crystalline material, and resin particles containing a releasing agent can be obtained as latex particles by polymerization treatment with the addition of initiator.

The water based medium means one in which at least 50 percent, by weight of water, is incorporated.

Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

Methods are preferred in which dispersion is carried out employing mechanical force. Said monomer solution is preferably subjected to oil droplet dispersion (essentially an embodiment in a mini-emulsion method), employing mechanical force, especially into water based medium prepared by dissolving a surface active agent at a concentration of lower than its critical micelle concentration. An oil soluble polymerization initiator may be added to the monomer solution in place of a part or all of water soluble polymerization initiator.

In the usual emulsion polymerization method, the crystalline material dissolved in oil phase tends to desorb. On the other hand sufficient amount of the crystalline material can be incorporated in a resin particle or covered layer by the mini-emulsion method in which oil droplets are formed mechanically.

Herein, homogenizers to conduct oil droplet dispersion, employing mechanical forces, are not particularly limited, and include, for example, "CLEARMIX", ultrasonic homogenizers, mechanical homogenizers, and Manton-Gaulin homogenizers and pressure type homogenizers.

The diameter of dispersed particles is 10 to 1,000 nm, and is preferably 30 to 300 nm.

Phase structure of crystalline material in a toner particle, namely, the shape coefficient and variation coefficient thereof, may be controlled by broadening the distribution of dispersion particle diameter.

Emulsion polymerization, suspension polymerization seed emulsion etc. may be employed as the polymerization method to form resin particles or covered layer containing the crystalline material. These polymerization methods are also applied to forming resin particles (core particles) or covered layer which do not contain the crystalline material.

The particle diameter of composite particles obtained by the process (1) is preferably from 10 to 1,000 nm in terms of weight average diameter determined employing an electrophoresis light scattering photometer "ELS-800" (produced by OTSUKA ELECTRONICS Co., Ltd.).

Glass transition temperature (Tg) of the composite resin particles is preferably from 48 to 74° C., and more preferably from 52 to 64° C. The Softening point of the composite resin particles is preferably from 95 to 140° C.

The softening point of the composite resin particles is preferably from 95 to 140° C.

The toner of the invention is prepared by forming resin layer by a salting-out/fusion method in which resin sparticles are fused on the surface of the particles composed of resin and colorant. The method is further described.

<Salting-out/Fusion Process>

Salting-out/fusion process is a process to obtain toner particles having undefined shape (aspherical shape) in which the composite resin particles obtained by the foregoing process and colored particles are aggregated.

Salting-out/fusion process of the invention is that the processes of salting-out (coagulation of fine particles) and fusion (distinction of surface between the fine particles) occur simultaneously, or the processes of salting-out and fusion are induced simultaneously. Particles (composite resin particles and colored particles) must be subjected to coagulation in such a temperature condition as lower than the glass transition temperature (Tg) of the resin composing the composite resin particles so that the processes of salting-out (coagulation of fine particles) and fusion (distinction of surface between the fine particles) occur simultaneously.

Particles of additives incorporated within toner particles such as a charge control agent (particles having average diameter from 10 to 1,000 nm) may be added as well as the composite resin particles and the colored particles in the salting-out/fusion process. A surface of the colored particles may be modified by a surface modifier.

(Digestion Process)

The digestion process is a process following to the salting-out/fusion process, wherein the crystalline material is subjected to phase separation by continuing agitation with constant strength keeping temperature close to the melting point of the crystalline material, preferably plus minus 20 centigrade of the melting point, after the coagulation of fine particles. The shape coefficient and variation coefficient thereof, may be controlled in this process.

Further, in the present invention, the total concentration of divalent (or trivalent) metal elements employed in coagulants and univalent metal elements added as coagulation inhibiting agents, described below, is preferably from 350 to 35,000 ppm. It is possible to obtain the residual amount of metal ions in toner by measuring the intensity of fluorescent X-rays emitted from metal species of metal salts (for example, calcium derived from calcium chloride) employed as coagulants, employing a fluorescence X-ray analyzer "System 3270 Type" (manufactured by Rigaku Denki Kogyo Co., Ltd.). One specific measurement method is as follows. A plurality of toners comprising coagulant metal salts, whose content ratios are known, are prepared, and 5 g of each toner is pelletized. Then, the relationship (a calibration curve) between the content ratio (ppm by weight) of said coagulant metal salts and the fluorescent X-ray intensity (being its peak intensity) is obtained. Subsequently, a toner (a sample), whose content ratio of the coagulant metal salt is to be measured, is pelletized in the same manner and fluorescent X-rays emitted from the metal species of said coagulant metal salt is measured, whereby it is possible to obtain the content ratio, namely "residual amount of metal ions in said toner".

(Filtration and Washing Process)

In said filtration and washing process, filtration is carried out in which said toner particles are collected from the toner particle dispersion, and washing is also carried out in which additives such as surface active agents, salting-out agents, and the like, are removed from the collected toner particles (a cake-like aggregate).

Herein, filtering methods are not particularly limited, and include a centrifugal separation method, a vacuum filtration method which is carried out employing Buchner funnel and the like, a filtration method which is carried out employing a filter press, and the like.

(Drying Process)

This process is one in which said washed toner particles are dried.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Further, when dried toner particles are aggregated due to weak attractive forces among particles, aggregates may be subjected to crushing treatment. Herein, employed as crushing devices may be mechanical a crushing devices such as a jet mill, a Henschel mixer, a coffee mill, a food processor, and the like.

The toner according to the invention is preferably produced by the following procedure, in which the compound resin particle is formed in the presence of no colorant, a dispersion of the colored particles is added to the dispersion of the compound resin particles and the compound resin particles and the colored particles are salted-out and fused.

In the foregoing procedure, the polymerization reaction is not inhibited since the preparation of the compound resin particle is performed in the system without colorant. Consequently, the anti-offset property is not deteriorated and contamination of the apparatus and the image caused by the accumulation of the toner is not occurred.

Moreover, the monomer or the oligomer is not remained in the toner particle since the polymerization reaction for forming the compound resin particle is completely performed. Consequently, any offensive odor is not occurred in the fixing process by heating in the image forming method using such the toner.

The surface property of thus produced toner particle is uniform and the charging amount distribution of the toner is sharp. Accordingly, an image with a high sharpness can be formed for a long period. The anti-offset and anti-winding properties can be improved and an image with suitable glossiness can be formed while a suitable adhesiveness or a high fixing strength with the recording material or recording paper or image support in the image forming method including a fixing process by contact heating by the use of such the toner which is uniform in the composition, molecular weight and the surface property of the each particles.

A releasing agent is preferably employed for improving fixing property. Practically, example includes a natural wax such as higher aliphatic acid ester, carnauba wax and rice wax, and crystalline polyester.

A particularly preferable example is an ester compounds represented by General Formula (5), described below.

$$R^1—(OCO—R^2)_n \qquad \text{Formula (5)}$$

In the formula, n represents an integer of 1 to 4, and preferably 2 to 4, more preferably 3 or 4, and in particular preferably 4.

$R^1$ and $R^2$ each represent a hydrocarbon group which may have a substituent respectively. $R^1$ has from 1 to 40 carbon atoms, and preferably 1 to 20, more preferably 2 to 5. $R^2$ has from 1 to 40 carbon atoms, and preferably 16 to 30, more preferably 18 to 26.

The representative examples are listed.

1)

$$CH_3—(CH_2)_{12}—COO—(CH_2)_{17}—CH_3$$

2)

$$CH_3—(CH_2)_{18}—COO—(CH_2)_{17}—CH_3$$

3)

$$CH_3—(CH_2)_{20}—COO—(CH_2)_{21}—CH_3$$

4)

$$CH_3—(CH_2)_{14}—COO—(CH_2)_{19}—CH_3$$

5)

$$CH_3—(CH_2)_{20}—COO—(CH_2)_6—O—CO—(CH_2)_{20}—CH_3$$

6)

$$CH_3—(CH_2)_{20}—COO—(CH_2)_2—\underset{}{\overset{CH_3}{\overset{|}{CH}}}—CH_2—O—CO—(CH_2)_{20}—CH_3$$

7)

$$CH_3—(CH_2)_{22}—COO—(CH_2)_2—\overset{CH_3}{\overset{|}{CH}}—CH_2—O—CO—(CH_2)_{22}—CH_3$$

-continued

8)

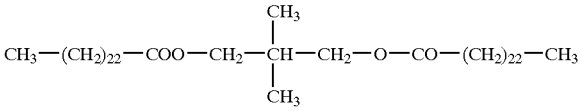

9)

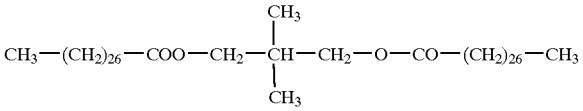

10)

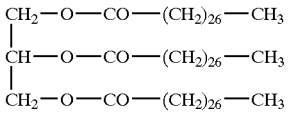

11)

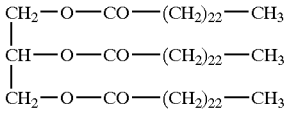

12)

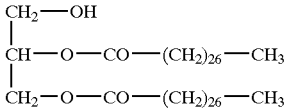

13)

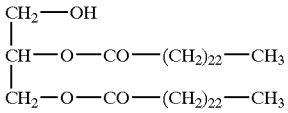

14)

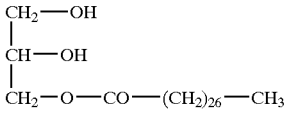

15)

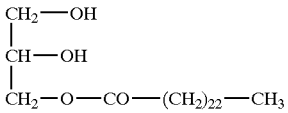

16)

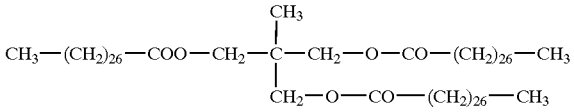

17)

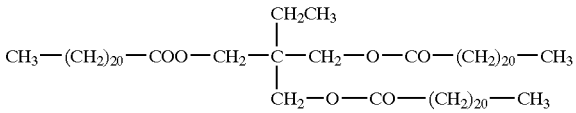

18)

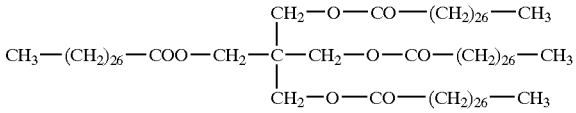

-continued

19)

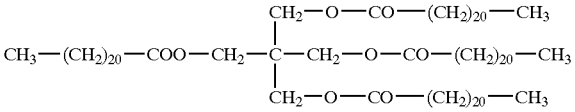

20)

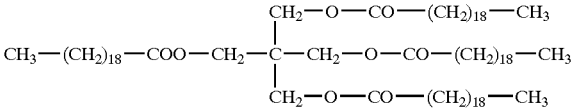

21)

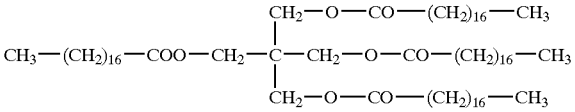

22)

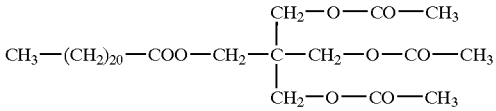

A crystalline compound having an ester group is contained in resin particles and has a function giving good fixing property, i.e., adhesion property to a support of image, to a toner obtained by fusing the resin particles.

Preferable examples are those having a melting point of 60 to 110° C., and more preferably are those having a melting point of 70 to 900° C.

Adhesion property to the paper etc. is improved by employing a crystalline compound having an ester group and a melting point from 60 to 110° C. Further, good anti-offset property is obtained since elasticity at the high temperature region is kept within preferable value.

The melting point of crystalline materials, as described herein, means the value measured by a differential scanning calorimeter (DSC). Specifically, when temperature increases at a rate of 10° C./minute from 0 to 200° C., the temperature, which shows the maximum peak of measured endothermic peaks, is designated as the melting point.

The number average molecular weight of crystalline materials is preferably between 1,500 and 15,000, and is more preferably between 2,000 and 10,000.

In the toner obtained employing crystalline materials having a number average molecular weight of 1,500 to 15,000, compatibility with amorphous polymers which are employed to realize a total decrease in the melt viscosity is improved in a molten state, and thus the fixability in the lower temperature range is enhanced.

Number average molecular weight is measured in the following condition.

Condition

Model of machine employed: LC −6 A (manufactured by Shimadzu Corp.)

Column: Ultrastyragel Plus

Analysis temperature: 60° C.

Solvent: m-cresol/chlorobenzene 3/1 (volume ratio)

Calibration curve: Standard polystyrene calibration curve

It is preferable that melt viscosity of a crystalline material (viscosity at melting point plus 20 degrees) is not more than 300 dPa·s and more preferably not more than 250 dPa·s.

When a crystalline material having melt viscosity of less than 300 dPa·s is employed, melt viscosity as a whole including the amorphous polymer can be lowered, and fixing ability improves in provided toner.

Melt viscosity of a crystalline material (viscosity by melting point plus 20 degrees) means a value measured by a cone plate viscometer.

Peak molecular weight of the crystalline material measured by GPC is with 6,000–50,000.

Crystalline polyester composing the toner in accordance with the present invention generally exhibits an endothermic peak (P1) in the range of 60 to 120° C. during the first temperature rising stage, as measured with a DSC.

(Polymerization Initiators)

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 90° C. is employed. However, by employing a combination of polymerization initiators such as hydrogen peroxide-reducing agent (ascorbic acid and the like), which is capable of initiating the polymerization at room temperature, it is possible to carry out polymerization at least room temperature.

(Chain Transfer Agents)

For the purpose of regulating the molecular weight of resinous particles, it is possible to employ commonly used chain transfer agents.

Said chain transfer agents are not particularly limited, and for example, employed are mercaptans such as octylmercaptan, dodecylmercaptan, tert-dodecylmercaptan, and the like.

A compounds represented by the General Formula (6) is preferably employed so as to reduce odor at the time of thermal fixing and to obtain a resin having sharp molecular weight distribution.

$$HS—R_1—COOR_2 \quad (6)$$

In the formula, $R_1$ is a divalent group having carbon atoms from 1 to 10, and $R_2$ is a group having carbon atoms from 2 to 20.

The divalent group having carbon atoms from 1 to 10 represented by $R_1$ includes a methylene, ethylene, trimethylene, allylene, tetramethylene, pentamethylene, hexamethylene, methoxyetylene, ethoxyethylene, ethyleneoxy, ethylenethio, phenetylene, 2-trifluoromethylethylene, 2,2,3,3,-tetrafluoroethylene, carbamoylethylene, hydroxyethylene, 2-(2-hydroxyethoxy) ethylene, or phenylene, naphthyl group, and so on.

The preferable example is a methylene, ethylene, trimethylene, tetramethylene, 3-methyltetramethylene, or ethyleneoxy group, and more preferable one is an ethylene group among above.

The group having carbon atoms from 2 to 20 represented by $R_2$ includes a branched or straight chain alkyl group having 2–20 carbon atoms such as a methyl, ethyl, propyl, butyl, isobutyl, hexyl, octyl, dodecyl, octadecyl, or nonadecyl group; an alkenyl group having 2–20 carbon atoms such as a 2-propenyl, 3-butenyl, 1-methyl-3-propenyl, 3-pentenyl, 1-methyl-3-butenyl, or 4-hexenel group; an aralkyl group having 7–20 carbon atoms such as a benzyl or phenethyl group; an aryl group or naphthyl group.

Particularly octyl group is preferably employed as $R_2$.

The group represented by $R_1$ and $R_2$ may be substituted by a group or an atom such as a halogen atom such as fluorine, chlorine, bromine, etc.; an alkoxy group such as a methoxy, ethoxy group etc.; an aryl group such as a phenoxy, p-tryloxy group, etc.; a cyano group; a carbamoyl group such as a carbamoyl, N-methylcarbamoyl, N,N-tetramethylenecarbamoyl group, etc.; a sulfamoyl group such as a sulfamoyl, N,N-3-oxapentamethyleneaminosulfonyl group, etc; a haloalkyl group such as a 2,2,2-trifluoroethyl, 2,2,3,3,-tetrafluoropropyl group, etc.; an alkylsulfonyl group such as a methanesulfonyl, methanesulfonyl group, etc.; an alkoxycarbonyl group such as an ethoxycarbonyl, butoxycarbonyl group, etc.; an aryl group such as a phenyl, carboxyphenyl group, etc.; an acyl group such as an acetylamino, benzoylamino group, etc.; or a sulfone amido group such as a methanesulfonamide, buthanesulfonamide group, etc.

Example of the chain transfer agent represented by the formula (6) is preferably 3-mervaptopropionic acid ester compound.

Practical examples of the 3-mervaptopropionic acid ester compound includes ethyl ester, octyl ester, decyl ester, dodecyl ester, pentaerythritoltetrakis ester of the 3-mervaptopropionic acid, 3-mervaptopropionic acid ester of ethyleneglycol, 3-mervaptopropionic acid ester of neopentylglycol, 3-mervaptopropionic acid ester of trimethylolpropane, 3-mervaptopropionic acid ester of pentaerythritol, 3-mervaptopropionic acid ester of sorbitan, etc. Particularly n-octyl-3-mercaptopropionic acid ester is preferable employed in view of inhibiting odor at the time of thermal fixing of the toner.

(Surface Active Agents)

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyltriphenylmethane-4,4-diazi-bis-β-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

In the present invention, surface active agents represented by General Formulas (1) and (2) are most preferably employed.

$$R^1(OR^2)_nOSO_4M \quad \text{General Formula (a)}$$

$$R^1(OR^2)_nSO_3M \quad \text{General Formula (b)}$$

In General Formulas (a) and (b), $R^1$ represents an alkyl group having from 6 to 22 carbon atoms or an arylalkyl group. $R^1$ is preferably an alkyl group having from 8 to 20 carbon atoms or an arylalkyl group and is more preferably an alkyl group having from 9 to 16 carbon atoms or an arylalkyl group.

Listed as alkyl group having from 6 to 22 carbon atoms represented by $R^1$ are, for example, an n-hexyl group, an n-heptyl group, an n-octyl group, an n-decyl group, an n-undecyl group, a hexadecyl group, a cyclopropyl group, a cyclopentyl group, and a cyclohexyl group. Listed as arylalkyl groups represented by $R^1$ are a benzyl group, a diphenylmethyl group, a cinnamyl group, a styryl group, a trityl group, and a phenethyl group.

In General Formulas (a) and (b), $R^2$ represents an alkylene group having from 2 to 6 carbon atoms. R2 is preferably an alkylene group having 2 or 3 carbon atoms. Listed as alkylene groups having from 2 to 6 carbon atoms represented $R^2$ are an ethylene group, a trimethylene group, a tetramethylene group, a propylene group, and an ethylethylene group.

In General Formulas (a) and (b), n represents an integer of 1 to 11; and n is preferably from 2 to 10, is more preferably from 2 to 5, and is most preferably 2 or 3.

In General Formulas (a) and (b), listed as univalent metal elements represented by M are sodium, potassium, and lithium of these, sodium is preferably employed.

Specific examples of surface active agents represented by General Formulas (1) and (2) are illustrated below:

Compound (101): $C_{10}H_{21}(OCH_2CH_2)_2OSO_3Na$

Compound (102): $C_{10}H_{21}(OCH_2CH_2)_3OSO_3Na$

Compound (103): $C_{10}H_{21}(OCH_2CH_2)_2OS_3Na$

Compound (104): $C_{10}H_{21}(OCH_2CH_2)_3OSO_3Na$

Compound (105): $C_8H_{17}(OCH_2CH_2(CH_3))2OSO_3Na$

Compound (106): $C_{18}H_{37}(OCH_2CH_2)_2OSO_3Na$

In the present invention, from the viewpoint of maintaining the electrostatic charge holding function of toner in the desired state, minimizing fogging at high temperature and high humidity, and improving transferability, as well as minimizing an increase in electrostatic charge at low temperature and low humidity, and stabilizing the development amount, the content of the surface active agents represented by the aforesaid General Formulas (a) and (b) in the electrostatic image developing toner is preferably from 1 to 1,000 ppm, is more preferably from 5 to 500 ppm, and is most preferably from 7 to 100 ppm.

In the present invention, by adjusting the amount of the surface active agents incorporated to said range, the static charge of the electrostatic image developing toner of the present invention is built up being independent of ambience, and can be uniformly and stably provided and maintained.

Further, the content of the surface active agents represented by the aforesaid General Formulas (a) and (b) is calculated employing the method described below.

One g of toner is dissolved in chloroform, and surface active agents are extracted from the chloroform layer employing 100 ml of deionized water. Further, said chloroform layer, which has been extracted, is further extracted employing 100 ml of deionized water, whereby 200 ml of extract (being a water layer) is obtained, which is diluted to 500 ml.

The resulting diluted solution is employed as a test solution which is subjected to coloration utilizing Methylene Blue based on the method specified in JIS 33636. Then, its absorbance is determined, and the content of the surface active agents in the toner is determined employing the independently prepared calibration curve.

Further, said extract is analyzed employing 1H-NMR, and the structure of the surface active agents represented by General Formulas (a) and (b) is determined.

The colorant employed in the invention is described.

The toner is obtained by salting out/fusing the composite resin particles and colored particles. Listed as colorants which constitute the toner of the present invention may be inorganic pigments, organic pigments, and dyes. Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

These inorganic pigments may be employed individually or in combination of a plurality of these, if desired. Further, the added amount of said pigments is commonly between 2 and 20 percent by weight with respect to the polymer, and is preferably between 3 and 15 percent by weight.

The magnetite mentioned above can be added in case of employing as a magnetic toner. It is preferable to incorporate in an amount of 20 to 60 weight percent in view of imparting required magnetic characteristics.

Organic pigments and dyes may be employed. Specific organic pigments as well as dyes are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, Pigment Yellow 155, Pigment Yellow 186, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

These organic pigments, as well as dyes, may be employed individually or in combination of selected ones, if desired. Further, the added amount of pigments is commonly between 2 and 20 percent by weight, and is preferably between 3 and 15 percent by weight.

Said colorants may also be employed while subjected to surface modification. As said surface modifying agents may be those conventionally known in the art, and specifically, preferably employed may be silane coupling agents, titanium coupling agents, aluminum coupling agents, and the like.

Examples of the silane coupling agent include alkoxysilane such as methyltrimethoxysilane, phenyltrimethoxysilane, methylphenyldimethoxysilane and diphenyldimethoxysilane; siloxane such as hexamethyldisiloxane, γ-chloropropyltrimethoxysilane, vinyltrichlorosilane, vinyltr,imethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, and γ-ureidopropyltriethoxysilane.

Examples of the titanium coupling agent include those marketed with brand "Plainact" TTS, 9S, 38S, 41B, 46B, 55, 138S, 238S etc., by Ajinomoto Corporation, A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP etc., marketed by Nihon Soda Co., Ltd.

Examples of the aluminum coupling agent include "Plainact AL-M".

These surface modifiers is added preferably in amount of 0.01 to 20% by weight, and more preferably 0.5 to 5% by weight with reference to the colorant.

Surface of the colorant may be modified in such way that the surface modifier is added to the dispersion of colorant, then the dispersion is heated to conduct reaction.

Colorant having subjected to the surface modification is separated by filtration and dried after repeating rinsing and filtering with the same solvent.

The average of the horizontal FERE diameter of the colorant particles employed in the present invention is preferably from 10 to 300 nm. Number of the colorant particles having the horizontal FERE diameter from 10 to 300 nm is preferably 50% or more.

The average of the horizontal FERE diameter of the colorant particles is more preferably from 50 to 300 nm. Number of the colorant particles having the horizontal FERE diameter from 10 to 300 nm is more preferably 60 to 100%.

The variation coefficient of the horizontal FERE diameter of the colorant particles is preferably no more than 40 percent, is more preferably no more, than 35 percent, and is particularly preferably no more than 30 percent. Said variation coefficient of the horizontal FERE diameter of the domain portion of the toner particle of the present invention is obtained employing the formula described below:

$$\text{variation coefficient of horizontal FERE diameter} = (S2/K2) \times 100 \text{ (in percent)}$$

wherein S2 is the standard deviation of the horizontal FERE diameter of 100 colorant particles, and K2 is their average horizontal FERE diameter.

The variation coefficient of the horizontal FERE diameter of the colorant particles in the toner particle, as described herein, refers to fluctuation of said horizontal FERE diameter average, that is, the fluctuation of the size of colorant particles.

While the variation coefficient of the horizontal FERE diameter is not more than 40 percent, it is not necessary to be 0 percent, i.e., there is no fluctuation in of the size of colorant particles.

The horizontal FERE diameter of colorant particles in a toner and its variation coefficient and so on can be obtained by observation, photo taking and image analysis employing transmission type electron microscopes such as LEM-2000 Type manufactured by Topcon Corp., or JEM-2000FX manufactured by JEOL Corporation.

Projections of at least 100 toner particles were prepared by a factor of 10,000 employing said transmission type electron microscope. Employing the resultant projections, desired values such as the number of domain portions in the interior of a toner are calculated.

Imaging employing the transmission type electron microscope is carried out employing the method which is commonly known to measure toner particles. Namely, a specific method for measuring the cross-section of a toner is as follows. After sufficiently dispersing toner particles into an epoxy resin which hardens at normal temperature, they may be buried and hardened. After dispersed into a fine styrene powder having a particle diameter of approximately 100 nm, the resultant dispersion is press-molded. Subsequently, if desired, the resultant block is dyed with triruthenium tetraoxide and triosmium tetraoxide in combination. Thereafter, a thin slice sample is prepared by cutting the resultant block, employing a microtome fitted with a diamond blade. Employing said sliced sample, the cross-sectional structure of toner particles is imaged employing a transmission type electron microscope (TEM). Employing the resultant photographs, the shape of the region of crystalline materials in, the toner particles was visually confirmed. At the same time, employing an image processing unit, "Luzex F", manufactured by Nireco Co., Ltd., installed in said electron microscope, the imaged information is processed, and the FERE diameter of the domain portion, the number of domains, and the shape factor in a toner particle are obtained.

The colorant particles are added to toner particles preferably a weight average particle diameter of fine coloring agent particles being from 2 to 300 nm, more preferably from 2 to 200 nm.

The water based dispersion medium comprises 50 to 100 weight percent of water, 0 to 50 weight percent of a water soluble organic solvent. The water soluble organic solvent includes methanol, ethanol, isopropanol, butanol, acetone, methylethylketone, tetrahydrofuran, and alcohol solvent which does not dissolve the obtained resin is preferable. The weight average particle diameter dispersed in a water based medium is determined employing an electrophoretic light scattering photometer "ELS-800" (manufactured by OTSUKA ELECTRONICS Co., Ltd.).

A preparation method of colored fine particles having the weight average particle size mentioned below is now described.

Preparation of Colorany Particles

Figure 2:
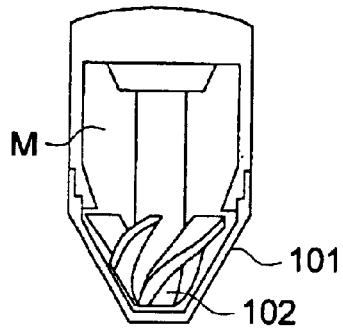
FIG. 2: A schematic view of a dispersion machine employed for obtaining colorant according to the invention
Figure 2:
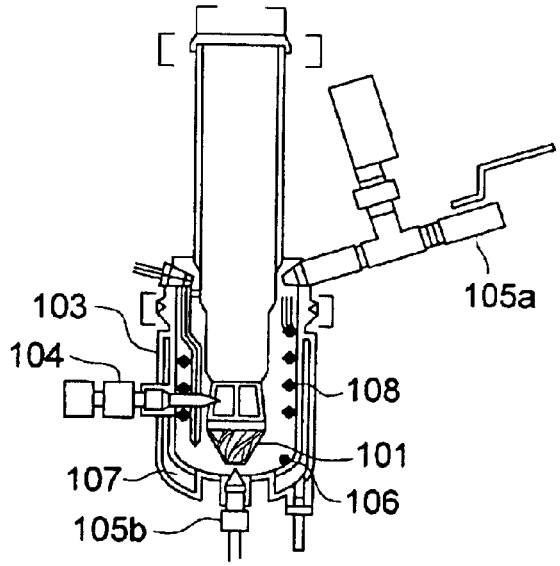
Figure 2:
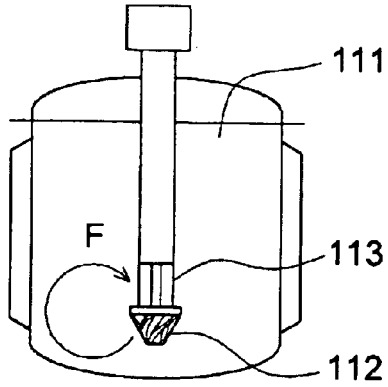

Colorant particles employed in obtaining toner is prepared by using a dispersion machine which disperses a colorant particles finely in the aqueous medium. The dispersion machine as shown by FIG. 2 is an example of the machine preferably employed in the invention. It produces a shearing force with a fixed screen separating the stirring room and a rotor stirring high speed, and the shearing force, as well as an impact force, pressure variation, cavitation, and a potential core makes the colorant particles dispersed finely in an aqueous medium containing a surfactant to obtain the colorant dispersion.

The water based medium to disperse the colored particles includes an aqueous solution dissolving a surfactant in concentration not less than critical micelle concentration (CMC). The surfactant may be the same as those employed in the polymerization process mentioned above.

Weight average particle size of the colorant fine particles (dispersion particle size) is preferably from 20 to 300 nm, more preferably from 2 to 200 nm.

Fine coloring agent particles employed in the toner of the present invention are prepared as follows. After a coloring agent is charged into a water based medium comprising surface active agents, preliminary dispersion (coarse dispersion) is initially carried out employing a propeller stirrer to prepare a preliminary dispersion in which coagulated particles of said coloring agent are dispersed. The resultant preliminary dispersion is supplied to a stirring apparatus provided with a screen to compartmentalize the stirring chamber and a rotor rotated at a high speed in said stirring chamber and is subjected to a dispersion treatment (being a fine dispersion treatment), employing said stirring apparatus, whereby a dispersion comprised of fine coloring agent particles in a preferred dispersion state is prepared.

Listed as said stirring device for a dispersion treatment to prepare fine coloring agent particles in a preferred dispersion state may be "CLEARMIX", manufactured by M Tech Co., Ltd. Said "CLEARMIX" comprises a rotor (a stirring blade), and a fixed screen (a fixed ring) surrounding said rotor, and has a structure which applies a shearing force, an impact force, pressure variation, cavitation, and a potential core to the treated composition. Said treated composition is effectively emulsify-dispersed utilizing synergistic functions generated by these actions.

The "CLEARMIX" is originally used to prepare an emulsion (being a dispersion of fine liquid droplets). A fine coloring agent particles dispersion, having a preferred average particles diameter as well as a markedly narrow size distribution, was prepared employing said "CLEARMIX" as an apparatus to disperse fine coloring agent particles into a water based medium in the present invention.

FIG. 2(*a*) is a schematic view showing a high speed rotating rotor and a fixed screen surrounding said rotor. In FIG. 2(*a*), numeral 101 is a screen and M is a compartmentalized stirring chamber, while 102 is a high speed rotating rotor in stirring chamber M.

Rotor 102 is a high speed rotating stirring blade. Its frequency of rotation is commonly from 4,500 to 22,000 rpm, and is preferably from 10,000 to 21,500 rpm. The peripheral speed of the tip of rotor 102 is commonly from 10 to 40 m/second, and is preferably from 15 to 30 m/second.

Screen 101 provided around rotor 102 is comprised of a fixed ring constituted of many slits (not shown). The slit width is commonly from 0.5 to 5 mm, and is preferably from 0.8 to 2 mm. Further, the number of slits is commonly from 10 to 50, and is preferably from 15 to 30. The clearance between rotor 102 and screen 101 is commonly from 0.1 to 1.5 mm, and is preferably from 0.2 to 1.0 mm.

The average diameter of fine coloring agent particle as well as the particle size distribution is adjusted by controlling the frequency of rotation of rotor 102, and further, may be adjusted by selecting the shape of screen 101 as well as rotor 102. Specifically, the preferred dispersion state is obtained by combinations of screen (S1. 0–24, S1. 5–24, S1. 5–18, S2. 0–18, and S3. 0–9) and said rotor (R1 through R4). However, a further preferred state may be obtained utilizing a unit prepared by an operator.

FIG. 2(*b*) is a schematic view showing a continuous type processing apparatus (CLEARMIX) provided with said rotor as well as said screen. A preliminary dispersed dispersion (being a preliminary dispersion) is supplied from preliminary dispersion inlet 104, shown in FIG. 2(*b*), to a stirring chamber between screen 101 and said rotor. Screen 101 as well as said rotor is surrounded by pressurized vacuum attachment 103, and thermal sensor 106, cooling jacket 107, and cooling coil 108 are arranged. Coloring agent coagulant particles in said preliminary dispersion are provided with a shearing force generated by said high speed rotating rotor and screen 101, and thereby pulverized (finely dispersed).

The coloring agent coagulated particles in the preliminary dispersion, supplied into the belt-shaped stirring chamber provided between screen 101 and said rotor, is subjected to a shearing force (mechanical energy) generated by said screen 101, and the high speed rotation of said rotor, and in addition, a collision force, pressure variation, cavitation, and the action of the potential core, so as to be pulverized (finely dispersed), whereby fine coloring agent particles are formed. The dispersion comprising said fine coloring agent particles is spouted into pressurized vacuum attachment 103 through the slits of screen 101. As a result, obtained is a dispersion comprising fine coloring agent particles, having a preferred average particle diameter as well as a narrow particle size distribution. Said dispersion, comprising fine coloring agent particles, is conveyed from dispersion outlet 105 to the next process.

The coloring agent coagulated particles are pulverized by the action of said rotor and screen in the stirring apparatus so as to form fine coloring agent particles (dispersed particles) having a preferred average particle diameter as well as a narrow particle size distribution. The formation mechanism of said fine coloring agent particles will be explained based on a plurality of actions described below.

(1) Since in a portion near the surface of a high speed rotating rotor (being a stirring blade), the speed gradient is large, a high speed shearing region is formed at the portion near said surface. As a result, said coloring agent coagulated particles are pulverized by the shearing force generated in said region.

(2) At the rear of said rotor (being a stirring blade), when said rotor rotates at a high speed, a vacuum region is generated. Air bubbles generated by the rotation are eliminated at the stage where the flow rate of the dispersion decreases. At the same time, along with the compression of said air bubbles, impact pressure is generated. Said coloring agent coagulated particles are pulverized by the resulting impact pressure.

(3) When said rotor (being a stirring blade) is rotated at a high speed, said preliminary dispersion is provided with pressure energy. When the resulting pressure energy is rapidly released, the motion energy of said preliminary dispersion is increased. When said preliminary dispersion, which is scattered by said rotor, repeatedly passes between the releasing section (slit section) and the tightly closed section (non-slit section), the resulting pressure energy varies. As a result, pressure waves are generated, thereby pulverizing said coloring agent coagulated particles.

(4) When said preliminary dispersion, having a large motion energy, collide with said screen or other walls, said coloring agent coagulated particles, which are subjected to the resulting collision force, are pulverized, whereby fine coloring agent particles are prepared which have a narrow range of particle size distribution.

(5) When a dispersion having a high velocity energy passes through the slit sections of said screen, a jet flow is formed. In the potential core (a velocity region which is not affected by the action of a viscous flow), the surrounding flow is sucked in at a high speed. The coloring agent coagulated particles, which are subjected to the resulting energy, are pulverized, whereby fine coloring agent particles, having a narrow range of particle size distribution, are prepared.

The time to prepare a fine coloring agent dispersion is commonly from 5 to 80 minutes, and is preferably from 7 to 65 minutes. Further, when circulated, at least 5 passes are preferred, and 5 to 20 passes are more preferred. It is not preferable that said dispersion time be excessively long because dispersion is excessively carried out and the existing amount of fine particles becomes greater than desired.

In order to prepare preferably usable fine coloring agent particles, a batch type dispersing process may be carried out in which a dispersion vessel provided with a stirring apparatus, comprised of said screen and said rotor, is employed, and a coloring agent (being a water based medium comprising a coloring agent) is spouted into the water based medium housed in said dispersion vessel from the stirring chamber of said stirring apparatus.

FIG. 2(*c*) is a schematic view of a dispersion vessel provided with said stirring apparatus (CLEARMIX), and the dispersion process is carried out employing said apparatus. In FIG. 2(*c*), numeral 111 is a dispersion vessel, 112 is a stirring apparatus, and 113 is a stirring shaft to drive said stirring apparatus 112. Said stirring apparatus 112 has the same constitution (said screen and said rotor) shown in FIG. 2(*a*).

Said preliminary dispersion (being a coloring agent coagulated particle dispersion) is introduced into said stirring chamber from the upper section of stirring apparatus 112 and is stirred utilizing a strong shearing force generated between said high speed rotating rotor and said screen, an impact force, and a turbulent flow, whereby fine coloring agent particles, having a weight average particle diameter of 30 to 300 nm, are formed, which are then spouted into dispersing vessel 111 from the slits of said screen. In said dispersion process of fine coloring agent particles, dispersion vessel 111 is subjected to a jacket structure and the temperature of the interior of dispersion vessel 111 may be controlled by flowing heated water, steam, and if desired, by flowing cold water.

When said dispersion process is carried out employing the dispersion vessel shown in FIG. 2(*c*), the spouting direction (the spouting direction of fine coloring agent particles into the water based medium) is preferably in a downward or horizontal direction. By spouting the coloring agent (being fine coloring agent particles) in the downward or horizontal direction, the water based medium flows as shown by arrow F. As a result, said coloring agent is spouted downward, and the resulting flow rises along the wall and is circulated to CLEARMIX. Due to that, it is possible to assuredly repeat said dispersion process, and it is also possible to uniformly provide dispersion energy to said coloring agent. As a result, it is assumed that it is possible to render the dispersed coloring agent particle diameter uniform. As described above, it is possible to effectively form fine coloring agent particles having a narrow range of particle size distribution.

Coloring agent particles preferably employed in the present invention are prepared by pulverizing coloring agent coagulated particles, utilizing the action of a shearing force generated by said screen and said rotor, as described above. As a result, a dispersion is prepared which is comprised of fine coloring agent particles (fine particles near primary particles) having a suitable average particle diameter (a weight average particle diameter commonly is 30 to 10,000 nm, is preferably 30 to 500 nm, and is more preferably 50 to 300 nm) as well as a narrow range of particle size distribution (having a standard deviation, a of less than or equal to 30). Such fine coloring agent particles (dispersion particles) are subjected to salting-out/fusion with fine resinous particles. As a result, said fine coloring agent particles are assuredly introduced into the interior of the resulting toner particle. Introduced coloring agent particles are not dislodged so that no fluctuation occurs with regard to the content ratio of said coloring agent in each of said toner particle.

As a result, when images are formed, employing the resulting toner which has been stored at high temperature and high humidity, or employing an image forming apparatus which has not been operated over an extended period of time, image problems, such as fogging due to the variation of charge amount and minute dots of dust do not occur. Further, in the present invention, since fine coloring agent particles are dispersed in the toner particle without using any media, image problems due to minute residual impurities such as crushed pieces of media in said toner do not occur.

The colored particles are subjected to salting out/fusion process in a state that they are dispersed in water based medium. The water based medium to disperse the colored particles includes an aqueous solution dissolving a surfactant in concentration not less than critical micelle concentration (CMC).

Homogenizers employed in the dispersion of the colored particles include, for example, "CLEARMIX", ultrasonic homogenizers, mechanical homogenizers, and Manton-Gaulin homogenizers, pressure type homogenizers and medium dispersion machines such as GETSMAN MILL and DIAMOND FINE MILL.

In order to simultaneously carry out salting-out and fusion, it is required that salting agent (coagulant) is added to the dispersion of composite particles and colored particles in an amount not less than critical micelle concentration and they are heated to a temperature of the glass transition temperature (Tg) or higher of the resin constituting composite particles.

Suitable temperature for salting out/fusion is preferably from (Tg plus 10° C.) to (Tg plus 50° C.), and more preferably from (Tg plus 15° C.) to (Tg plus 40° C.).

An organic solvent which is dissolved in water infinitely may be added in order to conduct the salting out/fusion effectively.

Further, in the present invention, after preparing colored particles (in the present invention, called toner particles) upon salting out, aggregating, and coalescing resin particles and colorants in a water based medium, separation of said toner particles from said water based medium is preferably carried out at a temperature of not lower than the Krafft point of the surface active agents in said water based medium, and is more preferably carried out in the range of said Krafft point to said Kraft point plus 20° C.

The Krafft point, as described herein, refers to the temperature at which an aqueous solution comprising a surface active agent starts to become milky-white. The Krafft point is measured as follows.

<<Measurement of Krafft Points>>

A solution is prepared by adding a coagulant in a practically employed amount to a water based medium employed in salting-out, aggregation, and coalescence processes, namely a surface active agent solution. The resulting solution is stored at 1° C. for 5 days. Subsequently, the resulting solution is heated while stirring until it becomes transparent. The temperature, at which said solution becomes transparent, is defined as its Krafft point.

From the viewpoint of minimizing excessive static charge to toner particles and providing uniform static-charge buildup to said toner particles, particularly in order to stabilize static-charge buildup against ambience, as well as to maintain the resulting static-charge buildup, the electrostatic image developing toner of the present invention preferably comprises the aforesaid metal elements (listed as such forms are metals and metal ions) in an amount of 250 to 20,000 ppm in said toner and more preferably in an amount of 800 to 5,000 ppm.

An image forming method, in which a plurality of color images employed in the image forming apparatus of the present invention is formed in the image forming section, and the resultant color images are superposed onto the same intermediate transfer body, and then transferred, will now be described with reference to FIG. 3.

Figure 3:
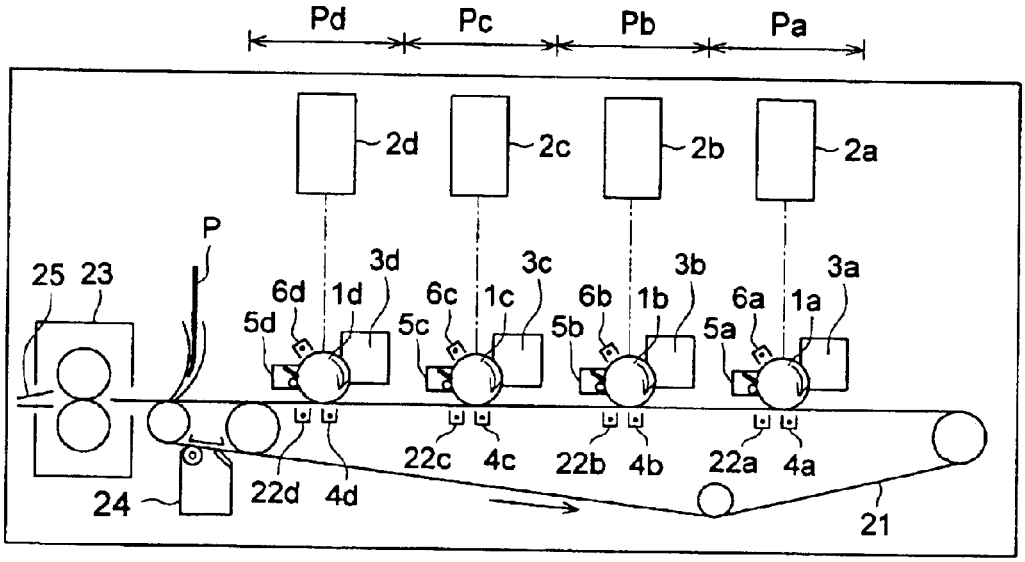
FIG. 3: A sectional view of rough sketch of an image forming apparatus employing transfer belt useable in the invention

FIG. 3 is a schematic view of a configuration of an example of an image forming apparatus employing an intermediate transfer body (a transfer belt).

Figure 5:
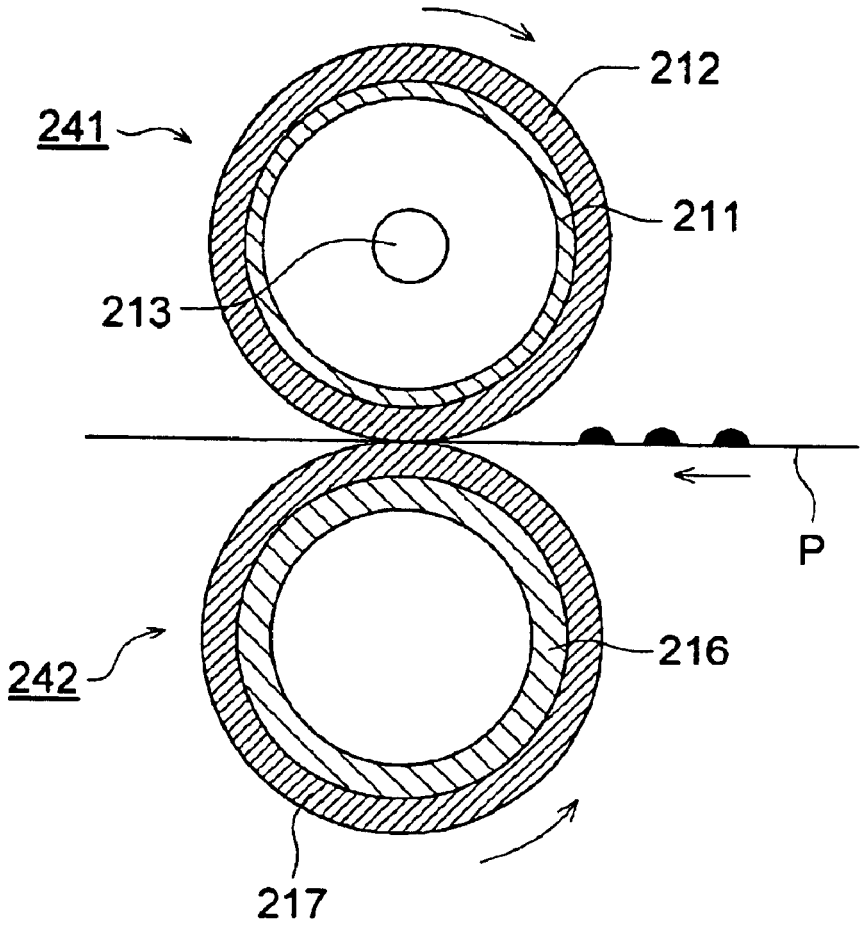
FIG. 5: A sectional view of rough sketch of a pressure contact fixing unit employed in the invention

In FIG. 5, the image forming apparatus to prepare color images is provided with a plurality of image forming units. In each image forming unit, a different color visual image (a toner image) is formed and said toner image is successively superposed onto the same intermediate transfer body, and then transferred.

Herein, first image forming unit Pa, second image forming unit Pb, third image forming unit Pc, and fourth image forming unit Pd are arranged in series. Each of said image forming sections is provided with each of photoreceptor 1*a*, 1*b*, 1*c*, and 1*d*, each of which is an electrostatic latent image forming body. Around each of photoreceptors 1*a*, 1*b*, 1*c*, and 1*d* are provided each of latent image forming sections 2*a*, 2*b*, 2*c*, and 2*d*, each of development sections 3*a*, 3*b*, 3*c*, and 3*d*, each of transfer discharge section 4*a*, 4*b*, 4*c*, and 4*d*, each of cleaning units 5*a*, 5*b*, 5*c*, and 5*d* comprising a cleaning member as well as a rubber blade, and each of charging units 6*a*, 6*b*, 6*c*, and 6*d*.

In said constitution, initially, for example, the yellow color component image of an original document is formed on photoreceptor 1*a* of first image forming unit Pa, employing latent image forming section 2*a*. Said latent image is developed to form a visible image, employing a developer comprising a yellow toner of development section 3*a*, and the developed image is transferred onto transfer belt 21 at transfer discharge section 4*a*.

During yellow toner image is transferred onto transfer belt 21, as described above, in second image forming unit Pb, a magenta color component latent image is formed on photoreceptor 1*b*, and subsequently is developed, employing a developer comprising a magenta toner in development section 3*b*, whereby a visual image is formed. Said visible image (a magenta toner image) is transfer-superposed on the specified position of said transfer belt 21 when said transfer belt, which has been subjected to transfer in said first image forming unit Pa, is conveyed to transfer discharge section 4*b*.

Subsequently, the image formation of a cyan component as well as a black component is carried out in the same manner as the method described above, employing third image forming unit Pc and fourth image forming unit Pd. As a result, on said transfer belt, the cyan toner image and the black toner image are superpose-transferred. When said image transfer is finished, a superposed multicolor image is prepared on said transfer belt 21. On the other hand, photoreceptors 1*a*, 1*b*, 1*c*, and 1*d*, which have finished the transfer, are subjected to removal of any residual toner, employing cleaning units 5*a*, 5*b*, 5*c*, and 5*d*, and are then employed to form the next image formation.

Transfer belt 21 is employed in the image forming apparatus. In FIG. 3, said transfer belt 21 is conveyed from right to left. During said conveyance process, said transfer belt 21 passes through each of transfer discharge sections 4*a*, 4*b*, 4*c*, and 4*d* in each of image forming units Pa, Pb, Pc, and Pd, and each color image is transferred.

When transfer belt 21 passes through fourth image forming unit Pd, an AC voltage is applied to separation charge eliminating unit 22*d*, and said transfer belt 21 is subjected to charge elimination, whereby all toner images are simultaneously transferred onto transfer material P.

In FIG. 3, 22*b*, 22*b*, 22*c*, and 22*d* each are a separation charge elimination discharging unit, respectively. Transfer belt 21, which has finished the transfer of toner images, is subjected to removal of the residual toner, employing cleaning unit 24 comprised of a brush type cleaning member in combination with a rubber blade, and is prepared for the next image formation.

Further, as described above, a multicolor superposed image is formed on transfer belt 21 such as a long conveying belt, and the resultant image is simultaneously be transferred onto a transfer material. Alternatively, it may be constituted in such a manner that an independent transfer belt is provided to each of the image forming units, and an image is successively transferred to a transfer material from said each transfer belt.

Further, employed as said transfer belt is a looped film which is prepared as described below. A 5 to 15 $\mu$m thick releasing type layer, the surface resistance of which is adjusted to $10^5$ to $10^8$ $\Omega$ by adding conductive agents to a fluorine based or silicone based resin, is provided onto an approximately 20 $\mu$m thick high-resistance film comprised of polyether, polyamide or tetrafluoroethylene-perfluorovinyl ether, having a surface resistance of greater than or equal to $10^{14}$ $\Omega$.

In the image forming method of the present invention, as described above, a toner image formed in the development process passes through a transfer process in which said image is transferred onto a transfer material. Subsequently, the transferred image is fixed in a fixing process. Listed as the suitable fixing method employed in the present invention may be a so-called contact heating system. Particularly listed as said contact heating system are a heat pressure fixing system, and further, a heating roller fixing system, as well as a pressure contact heating fixing system in which fixing is carried out employing a rotating pressing member which includes in its interior a fixedly installed heating body.

Said heating roller fixing system is constituted of an upper roller and a lower roller. Said upper roller is formed by covering, with tetrafluoroethylene or polytetrafluoroethylene-perfluoroalkoxyvinyl ether copolymers, the surface of a metal cylinder comprised of iron or aluminum, which has a heating source in its interior, and said lower roller is formed employing silicone rubber. The representative example of said heating source is one having a linear heater which heats the surface of said upper roller to about 120 to 200° C. Pressure between said upper roller and said lower roller is applied in the fixing section and a so-called nip is formed by deformation of said lower roller. The resultant nip width is commonly from 1 to 10 mm, and is preferably from 1.5 to 7 mm. The linear fixing velocity is preferably from 40 to 600 mm/second. When said nip width is less than said lower limit, it becomes difficult to uniformly provide heat to a toner, whereby uneven fixing occurs. On the other hand, when said nip width is greater than said upper limit, problems with excessive off-setting during fixing occur due to the enhancement of melting resins.

A fixing-cleaning mechanism may be provided. Employed as systems to achieve said mechanism may be a system in which silicone oil is supplied onto the upper fixing roller or film, and a system in which cleaning is carried out utilizing a pad, a roller, or a web each of which are impregnated with silicone oil.

Further, the image forming apparatus, employed in the present invention, may have a mechanism which carries out toner recycling in which a non-transferred toner, which remains on the surface of the photoreceptor, is subjected to recycling. Listed as systems to carry out toner recycling may be, for example, a method in which toner, recovered in the cleaning section, is conveyed employing a conveyer or a conveying screw to a hopper for supplying the toner or a development unit, or is mixed with supply toner in an intermediate chamber and is then supplied to the development unit. Listed as preferred systems may be a system in which recovered toner is directly returned to the development unit, or a system in which recycled toner is mixed with supply toner in the intermediate chamber and is then supplied.

EXAMPLES

The present inventing will now be detailed with reference to examples.

Preparation Example of Resin for Toner

Preparation of Latex 1

(1) Preparation of Core Particle (The First Step of Polymerization)

In a 5,000 ml separable flask with a stirrer, a thermal sensor, a cooler and a nitrogen supplying apparatus, a surfactant solution composed of 3,010 g of ion-exchanged water and, dissolved therein, 7.08 g of anionic surfactant (101), $C_{10}H_{21}(OCH_2CH_2)_2OSO_3Na$, was charged as an aqueous medium. The temperature of the content was raised up to 80° C. while stirring at 230 rpm under a nitrogen gas stream.

Into the surfactant solution, an initiator solution composed of 1.5 g of polymerization initiator, potassium persulfate KPS, dissolved in 200 g of ion exchanged water and the temperature of the content was adjusted to 75° C. Then a monomer mixture liquid composed of 80 g of styrene, 16 g of n-butyl acrylate, 4 g of methacrylic acid and 3.0 g of n-octyl-3-mercaptopropionic acid ester was dropped into the solution spending 1 hour. This system was heated and stirred for 2 hours for carrying out polymerization or the first step of polymerization. Thus latex, a dispersion of resin particle was prepared. The latex was referred to as Latex H.

(2) Formation of interlayer (The second step of polymerization) Preparation of Latex 1HM In a flask with a stirrer, 98.0 g of Exemplified Compound 19 was added as a releasing agent to a monomer mixture liquid composed of a 120 g of styrene, 24 g of n-butyl acrylate, 6 g of methacrylic acid and 4.5 g of n-octyl-3-mercaptopropionic acid ester. The content was heated at 90° C. for dissolving the releasing agent. Thus Monomer Solution was prepared.

Besides, a surfactant solution composed of 2700 ml of ion exchanged water and, dissolved therein, 1.6 g of the foregoing anionic Surfactant 101 was heated by 98° C. and 28 g in terms of the solid ingredient of the dispersion of the core particle Latex 1H was added to the surfactant solution. Then the foregoing Monomer Solution was mixed into the surfactant solution containing Latex 1H by a mechanical dispersing machine CLEARMIX having a circulation channel, manufactured by M-Tech Co., Ltd., and dispersed for 8 hours to prepare an emulsion which contains emulsified particles (oil drops) having an average particle size of 284 nm.

Then, an initiator solution composed of 240 ml of ion-exchanged water and, dissolved therein, 4.5 g of the polymerization initiator KPS and 750 ml of ion-exchanged water was added to the emulsion. This system was heated and stirred at 98° C. for 12 hours for carrying out polymerization, the second step of polymerization. Thus latex, a dispersion of a combined resin particle comprising the high molecular weight resin particle covered by an intermediate molecular weight resin was prepared. This latex was referred to as Latex 1HM.

(3) Formation of Outer Layer (the Third Step of Polymerization) Preparation of Latex 1

To the foregoing Latex 1HM, an initiator solution composed of 200 ml of ion-exchanged water and, dissolved therein, 6 g of the polymerization initiator KPS was added and a monomer mixture of 320 g of styrene, 64 g of n-butyl acrylate, 16 g of methacrylic acid, 12 g of polyfunctional polymerizable monomer (1-1) and 12 g of n-octyl-3-mercaptopropionic acid ester was dropped spending 1 hour.

After the dropping, polymerization, the third step of polymerization was carried out by heating and stirring for 2 hours. Then the reaction liquid was cooled by 28° C. Thus latex, a dispersion of a combined resin particle comprising core particle of the high molecular weight resin, an inter layer of the middle molecular weight resin containing exemplified compound 19, and an outer layer of low molecular weight resin was prepared. This latex was referred to as Latex 1.

The composite resin particle of Latex 1 has a weight average particle diameter was 122 nm.

Preparation of Latex 2

Latex 2 was prepared in the same manner as in Latex 1 except that the polyfunctional polymerizable monomer (2-5) was employed in place of polyfunctional polymerizable monomer (1-1) in the Third Step of Polymerization.

Preparation of Latex 3

Latex 3 was prepared in the same manner as in Latex 1 except that the polyfunctional polymerizable monomer (3-2) was employed in place of polyfunctional polymerizable monomer (1-1) in the Third Step of Polymerization. Preparation of Latex 4

Latex 4 was prepared in the same manner as in Latex 1 except that the polyfunctional polymerizable monomer (4-1) was employed in place of polyfunctional polymerizable monomer (1-1) in The Third Step of Polymerization.

Preparation of Latex 5

Latex 5 was prepared in the same manner as in Latex 1 except that the amount of polyfunctional polymerizable monomer (1-1) was modified to 32 g in the third step of polymerization.

Preparation of Latex 6

Latex 6 was prepared in the same manner as in Latex 1 except that that 12 g of divinylbenzene was employed in place of polyfunctional polymerizable monomer (1-1) in the third step of polymerization.

Preparation of Latex 7 Comparative Sample

Latex 7 was prepared in the same manner as in Latex 1 except that the amount of polyfunctional polymerizable monomer (1-1) was modified to 48 g in the third step of polymerization.

Preparation of Latex 8 Comparative Sample

Latex 8 was prepared in the same manner as in Latex 1 except that polyfunctional polymerizable monomer (1-1) was not employed in the third step of polymerization.

Preparation of Colorant Dispersion

Preparation of Magenta Colorant dispersion

In 1,600 ml of ion-exchanged water, 59.0 g of anionic Surfactant (101) was dissolved by stirring. To the solution, 420.0 g of Pigment Red 122, manufactured by Cabot Co., Ltd., was gradually added and dispersed by CLEARMIX, manufactured by M-Tech Co., Ltd., to prepare a dispersion of the colorant particle. The dispersion of the colorant was referred to as Colorant Dispersion 1.

The weight average diameter of the colorant particle in Colorant Dispersion 1 was 110 nm according to the measurement by electrophoresis light scattering photometer ELS-800, manufactured by OTSUKA ELECTRONICS CO., LTD.

Preparation of Colored Particles 1 to 8 Preparation of Particles by Coagulation/Fusion Association In a four mouth flask as the reaction vessel to which a thermal sensor, cooler, nitrogen conduction apparatus and stirrer were attached, 420.7 g in terms of solid component of each of the foregoing Latex 1 to 8, 900 g of ion-exchanged water 200 g of Magenta Colorant Dispersion were charged and stirred.

The content was heated by 30° C. and the pH of the liquid was adjusted to 8 to 11.0 by the addition of a sodium hydroxide solution having a concentration of 5 moles/liter.

Subsequently, an aqueous solution prepared by dissolving 12.1 g of magnesium chloride heptahydrate in 1,000 ml of deionized water was added at 30° C. over 10 minutes. After setting the resulting mixture aside for 3 minutes, it was heated so that the temperature was increased to 90° C. over 30 minutes to make the particle diameter grown by coagulation.

While maintaining the resulting state, the diameter of coalesced particles was measured employing a "Coulter Counter TA-II". When the volume average particle diameter reached 4 to 7 μm, the growth of particles was terminated by the addition of an aqueous solution prepared by dissolving 40.2 g of sodium chloride in 1,000 ml of deionized water, and further fusion was continually carried out at a liquid media temperature of 98° C. for 2 hours, while being heated and stirred. Thus the colored particles 1 to 8 were obtained.

Preparation of Toner

Added to each of said Colored Particles 1 through 8 was hydrophobic silica (having a hydrophobicity of 68 and a number average primary Particles diameter of 12 nm) in an amount of 0.3 percent by weight, and thus the toner examples were obtained. Resulting toners were designated as Toners 1 through 6 and Comparative Toners 7 and 8.

Specifications of the obtained toners are summarized in Table 1. The specifications include kind of monomer having polar group, added amount, molecular weight property, flow softening point.

Preparation of Two-component Developer

Silicone resin-coated ferrite carrier having a volume average Particles diameter of 60 μm was added to each of toners 1–8 and comparative toner so as to have a toner concentration of 6 percent. Resulting mixtures were designated as Developers 1 through 8, corresponding to each of the cited toners.

The printing test was conducted employing the toners by means of a digital color copying machine having similar constitution to an image forming machine as shown by FIG. 3, with some modification as described below. As the fixing unit, a pressure contact type thermal fixing unit as shown in FIG. 5 was employed.

The fixing unit comprises a heating roller 241 (an upper roller) comprised of a cylindrical aluminum pipe 211 with a diameter of 40 mm and thickness of 1.0 mm, having an overcoat 212 on its surface with a tetrafluoroethylene-perfluoroalkyl vinyl ether copolymer (PFA) having thickness of 120 μm, which has a centered heater 213 with a length of 310 mm in its interior, and a lower roller (lower roller) 242 comprised of iron having a diameter of 40 mm and thickness of 2.0 mm covered with sponge silicone rubber 217 having an Ascar C hardness of 48 and thickness of 2 mm. The nip width was set at 5.8 mm. The printing line speed was set as 250 mm/second.

Further, employed as a cleaning mechanism of said fixing unit was a supply system of a web system impregnated with polydiphenylsilicone (having a viscosity of 10 Pa s at 20° C.). The fixing temperature was controlled employing the surface temperature of the upper roller and was set at 180° C.

Measurement of Glossiness

Samples in 75° specular glossiness were by Gloss Meter (available from Murakami Shikisai Kenkyujo Co. An unfixed toner image having toner amount of 0.5 mg/cm$^2$ was fixed by the fixing unit at 160° C. to which a releasing agent is stopped and no releasing agent was not on the heating roller.

The samples were ranked as follows.

A: 70 or more.

B: 60 or more and not more than 70.

C: 10 or more and not more than 60.

Measurement of Fixing Temperature

An unfixed toner image having toner amount of 0.5 mg/cm$^2$ was fixed by the fixing unit in which temperature of the heating roller and pressure roll was control optionally,

TABLE 1

| Toner/ Latex No. | Monomer having polar group Kind (amount in percent by weight) | Polyfunctional monomer** Kind (amount in percent by weight) | *1 | *2 | *3 | *4 | Tsp in ° C. | Dn 50 in μm | |
|---|---|---|---|---|---|---|---|---|---|
| 1 | Methacrylic acid (4) | 1-1 (3) | 5.1 | 9,400 | 9,100 | 2.11 | 103 | 6.0 | Inv. |
| 2 | Methacrylic acid (4) | 2-5 (3) | 8.9 | 9,500 | 9,300 | 2.13 | 105 | 6.0 | Inv. |
| 3 | Methacrylic acid (4) | 3-2 (3) | 6.2 | 9,100 | 8,900 | 1.98 | 102 | 6.0 | Inv. |
| 4 | Methacrylic acid (4) | 4-1 (3) | 9.5 | 9,900 | 9,700 | 2.01 | 104 | 6.0 | Inv. |
| 5 | Methacrylic acid (4) | 1-1 (8) | 13.0 | 9,900 | 9,600 | 2.18 | 107 | 6.0 | Inv. |
| 6 | Methacrylic acid (4) | Divinyl-benzene (3) | 20.0 | 18,000 | 30,400 | 3.50 | 114 | 6.0 | Inv. |
| 7 | Methacrylic acid (4) | 1-1 (12) | 25.0 | 13,000 | 20,800 | 3.03 | 120 | 6.0 | Comp. |
| 8 | Methacrylic acid (4) | Not used (-) | 2.4 | 8,700 | 8,700 | 2.1 | 101 | 6.0 | Comp. |

Polyfunctional monomer**: Polymerizable polyfunctional monomer having long chain.

*1: Ratio of area having molecular weight of 60,000 to 1,000,000.

*2: Molecular weight at peak or shoulder of molecular area of 5,000 to 20,000.

*3: Weight average molecular weight.

*4: Molecular weight distribution Mw/Mn.

and a releasing agent is stopped to the heating roller and no releasing agent was not on the heating roller. The transfer sheet having unfixed toner image was fixed at each temperature varied stepwise. Toner stain in non-image area occurred from heating roller was observed, and the temperature range, at which no stain was observed, was made to be non-off set range. The samples were ranked according to the lowest non-off set temperature as follows.

A: Not more than 120° C.

B: More than 120° C. and not more than 130° C.

C: More than 130° C.

Measurement of Fixing Property

The fixation strength of the resultant fixed images was evaluated based on the fixation ratio which was obtained employing the method in accordance with the mending tape peeling method described in Chapter 9, 1.4 Item of "Denshishashin Gijutsu no Kiso to Ohyoh (Basis and Application of Electrophotographic Technology), edited by Denshishashin Gakkai.

Specifically, after preparing a fixed solid image of 2.54 cm square having a toner adhesion amount of 0.6 mg/cm$^2$, the image density before and after peeling off Scotch Mending Tape (manufactured by Sumitomo 3M Limited) was determined and the residual ratio of the image density was obtained as a fixation ratio. The image density was measured employing a Macbeth Reflection Densitometer RD-918. Fixing temperature, which resulted in the fixation ratio of at least 95 percent, was designated as a fixability temperature.

Herein, evaluation criteria are as follows:

A: Not less than 95° C.

B: Not less than 80° C. and less than 95° C.

C: Less than 80° C.

Measurement in Anti-bending Strength

Anti-bending Strength was measured in terms of fixing ratio at the folding area.

The fixing ratio at the folding area is shown in terms of released toner ratio when a substance having fixed toner image is folded.

A sheet having solid toner image of density at 0.8 was folded and it was rubbed three times with finger, the toner image was wiped with JK wiper (produced by Kuresia Co., Ltd.) three times. The ratio is calculated by the image density before and after the folding through the following formula.

Fixing Ratio (%)=(Image density after folding)/(Image density before folding)×100.

Herein, evaluation criteria are as follows:

A: 80–100%

B: Not more than 80%

The result is summarized in Table 2.

TABLE 2

| Developer No. | Glossiness | Fixing temperature | Fixing property | Anti-bending | Remarks |
|---|---|---|---|---|---|
| 1 | A | A | A | A | Inv. |
| 2 | A | A | A | A | Inv. |
| 3 | A | A | A | A | Inv. |
| 4 | A | A | A | A | Inv. |
| 5 | B | A | A | A | Inv. |
| 6 | B | B | A | A | Inv. |
| 7 | C | C | C | A | Comp. |
| 8 | A | A | A | B | Comp. |

Samples of the invention demonstrate good results in comparison with the comparative samples in glossiness, fixing temperature, and fixing property and excellent in anti-bending bending strength.

Example 2

Preparation of Single-component Developer

Each of toners 1 to was employed as a non-magnetic single component developer without further processing.

Evaluation of Single Component Developer

Figure 4:
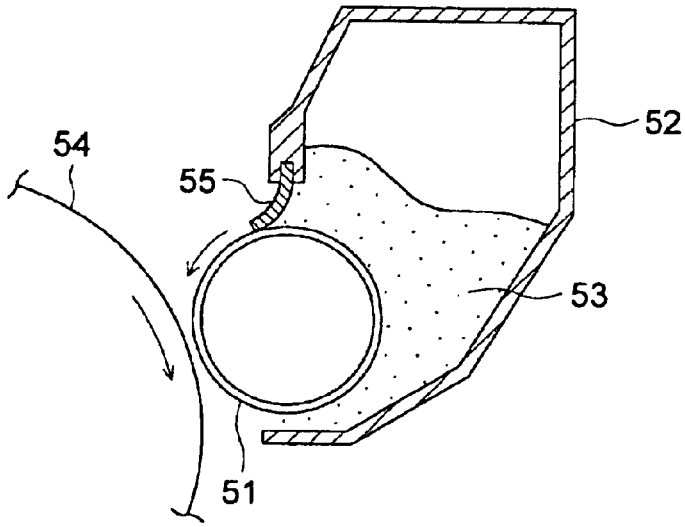
FIG. 4: A sectional view of rough sketch of a developing unit employed in the invention

Image forming test was conducted for the single component toners 1 to 8 by employing a color image forming apparatus as shown in FIG. 3, which has a developing unit as shown in FIG. 4, in high temperature and high humidity circumstance (33° C., 80% RH).

The pressure contact type thermal fixing unit as shown in FIG. 5 was employed in the similar way to Example 1, wherein the printing line speed was 180 mm/second. The surface of the heating roller was covered with PFA tube having thickness of 50 μm. Dimethyl silicone having a viscosity of 10 Pa s at 20° C. was provided to the cleaning unit by web in which the dimethyl silicone was impregnated. Amount of silicone oil coating was 0.1 mg per A4 size sheet. Fixing temperature was set at 175° C. by controlling the surface temperature of the heating roller. The samples were evaluated in the same way that conducted in the Example 1. The result is summarized in Table 3.

TABLE 3

| Developer No. | Glossiness | Fixing temperature | Fixing property | Anti-bending | Remarks |
|---|---|---|---|---|---|
| 1 | A | A | A | A | Inv. |
| 2 | A | A | A | A | Inv. |
| 3 | A | A | A | A | Inv. |
| 4 | A | A | A | A | Inv. |
| 5 | B | A | A | A | Inv. |
| 6 | B | B | A | A | Inv. |
| 7 | C | C | C | A | Comp. |
| 8 | A | A | A | B | Comp. |

Sample of the invention demonstrate good results in comparison with the comparative samples in glossiness, fixing temperature, and fixing property and excellent in anti-bending strength.

What is claimed is:

1. An electrostatic image developing toner comprising a resin and a colorant, wherein the resin comprises a polymerization component of a polymerizable monomer having a polar group in an amount of 1.0 to 10.0 percent by weight, and a polymerization component of a polyfunctional polymerizable monomer having two polymerizable functional groups in an amount of 0.1 to 10.0 percent by weight with reference to whole weight of polymerizable monomer; ratio (A/B) is from 0.5 to 20.0 percent; and either a peak or a shoulder is positioned in the molecular weight region of 5,000 to 20,000, wherein A is an area of a chromatograph curve in the molecular weight region of 60,000 to 1,000,000, based on GCP measurement of a THF soluble component of toner and B is an entire area of the chromatograph curve.

2. The electrostatic image developing toner of claim 1, wherein the polyfunctional polymerizable monomer is a compound represented by Formulas (1) through (4);

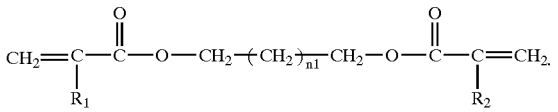

In the formula each of $R_1$ and $R_2$ is a hydrogen atom, an alkyl group having 1 to 6 carbon atoms or a cycloalkyl group, $n_1$ is an integer of 1 to 32;

Formula (2)

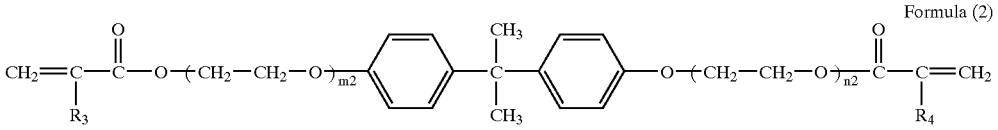

In the formula each of $R_3$ and $R_4$ is a hydrogen atom, an alkyl group having 1 to 6 carbon atoms or a cycloalkyl group, each of $m_2$ and $n_2$ is an integer, the sum of $m_2$ and $n_2$ being 1 to 32;

Formula (3)

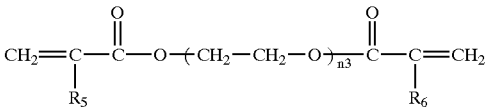

In the formula each of $R_5$ and $R_6$ is a hydrogen atom, an alkyl group having 1 to 6 carbon atoms or a cycloalkyl group, $n_3$ is an integer of 1 to 32;

Formula (4)

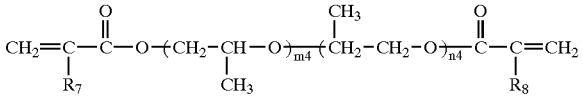

In the formula each of $R_7$ and $R_8$ is a hydrogen atom, an alkyl group having 1 to 6 carbon atoms or a cycloalkyl group, each of $m_4$ and $n_4$ is an integer, the sum of $m_4$ and $n_4$ being 1 to 32.

3. The electrostatic image developing toner of claim 1, wherein the ratio (A/B) is from 1 to 12 percent.

4. The electrostatic image developing toner of claim 3, wherein the ratio (A/B) is from 5 to 10 percent.

5. The electrostatic image developing toner of claim 1, wherein either a peak or a shoulder is positioned in the molecular weight region of 6,000 to 10,000.

6. The electrostatic image developing toner of claim 1, wherein the resin comprises the polymerization component of a polyfunctional polymerizable monomer in an amount of 0.5 to 7 percent by weight.

7. The electrostatic image developing toner of claim 6, wherein the resin comprises the polymerization component of a polyfunctional polymerizable monomer in an amount of 1 to 5 percent by weight.

8. The electrostatic image developing toner of claim 1, wherein the toner has a softening point of from 95 to 110° C.

9. The electrostatic image developing toner of claim 1, wherein the toner is prepared via a process in which the resin is prepared by polymerizing polymerizable monomers in a water based medium.

10. The electrostatic image developing toner of claim 1, wherein the toner contains toner which is prepared via a process in which resinous particles are aggregate-fused in a water based medium.

11. A production method of an electrostatic image developing toner of claim 1, comprising a process in which a binding resin is prepared by polymerizing a polymerizable monomer in a water based medium.

* * * * *